US010753544B2

(12) United States Patent
Froehler

(10) Patent No.: US 10,753,544 B2
(45) Date of Patent: Aug. 25, 2020

(54) DRIVE SYSTEM FOR CHEMICAL INJECTION PUMPS AND INSTRUMENT AIR COMPRESSORS

(71) Applicant: Anthony Steven Froehler, Calgary (CA)

(72) Inventor: Anthony Steven Froehler, Calgary (CA)

( * ) Notice: Subject to any disclaimer, the term of this patent is extended or adjusted under 35 U.S.C. 154(b) by 195 days.

(21) Appl. No.: 15/564,668

(22) PCT Filed: Apr. 6, 2016

(86) PCT No.: PCT/CA2016/050393

§ 371 (c)(1),
(2) Date: Oct. 5, 2017

(87) PCT Pub. No.: WO2016/161508

PCT Pub. Date: Oct. 13, 2016

(65) Prior Publication Data

US 2018/0087720 A1 Mar. 29, 2018

Related U.S. Application Data

(60) Provisional application No. 62/145,121, filed on Apr. 9, 2015, provisional application No. 62/300,626, filed on Feb. 26, 2016.

(51) Int. Cl.
*F04B 9/04* (2006.01)
*F17D 3/12* (2006.01)
(Continued)

(52) U.S. Cl.
CPC ..... *F17D 3/12* (2013.01); *E21B 43/12* (2013.01); *F04B 1/0536* (2013.01); *F04B 9/045* (2013.01);
(Continued)

(58) Field of Classification Search
CPC .... F04B 9/042; F04B 27/0536; F04B 1/0536; F04B 9/045; F04B 23/06; F04B 19/06;
(Continued)

(56) References Cited

U.S. PATENT DOCUMENTS 1,820,883 A * 8/1931 Hueber ..... F04B 27/0409 417/273
4,416,588 A * 11/1983 Karliner ..... B05B 7/32 417/199.1
(Continued)

FOREIGN PATENT DOCUMENTS

| | | |
|---|---|---|
| EP | 1245830 | 10/2002 |
| EP | 1936187 | 6/2008 |
| WO | 2007140596 | 12/2007 |

OTHER PUBLICATIONS

Burwell, Daniel, International Search Report for PCT/CA2016/050393, dated Jul. 28, 2016, 5 Pages, ISA/CA, Gatineau, Quebec, Canada.
(Continued)

*Primary Examiner* — Peter J Bertheaud
*Assistant Examiner* — Dnyanesh G Kasture
(74) *Attorney, Agent, or Firm* — Christopher J. Dynowski; Ade & Company Inc.; Ryan W. Dupuis

(57) ABSTRACT

A planetary drive system that aligns four fluid ends for a pump or four compressor cylinders in the same plane, allowing for four fluid ends/compressor cylinders to be driven by one rotation of the pump's motor. Additionally, the planetary drive system is stackable to allow, for example eight, twelve, or other multiples of fluid ends or compressor cylinders to be driven while minimizing any reduction in output pressure. The chemical injection pump also includes threaded vents on the fluid ends to capture chemicals primed through the valves to avoid spillage and waste during the
(Continued)

priming process. The air compressor cylinders also include pistons with enhanced vacuum actuation under a flexible inlet (e.g. flapper inlet).

14 Claims, 25 Drawing Sheets

(51) Int. Cl.

| | |
|---|---|
| ***F04B 1/0536*** | (2020.01) |
| ***F04B 27/053*** | (2006.01) |
| ***F04B 17/03*** | (2006.01) |
| ***F04B 19/06*** | (2006.01) |
| ***F04B 53/16*** | (2006.01) |
| ***F04B 35/04*** | (2006.01) |
| ***E21B 43/12*** | (2006.01) |
| ***F04B 23/06*** | (2006.01) |
| ***F04B 35/01*** | (2006.01) |
| *E21B 37/06* | (2006.01) |
| *E21B 41/02* | (2006.01) |

(52) U.S. Cl.
CPC ..... *F04B 9/047* (2013.01); *F04B 17/03* (2013.01); *F04B 19/06* (2013.01); *F04B 23/06* (2013.01); *F04B 27/0536* (2013.01); *F04B 35/01* (2013.01); *F04B 35/04* (2013.01); *F04B 53/16* (2013.01); *E21B 37/06* (2013.01); *E21B 41/02* (2013.01)

(58) Field of Classification Search
CPC ..... F04B 9/047; F04B 53/16; F04B 17/03; F04B 35/04; E21B 43/12; E21B 41/02; E21B 37/06; F17D 3/12
See application file for complete search history.

(56) References Cited

U.S. PATENT DOCUMENTS

| | | | | |
|---|---|---|---|---|
| 5,195,876 A * | 3/1993 | Hansen | F04B 53/007 417/307 |
| 5,356,267 A * | 10/1994 | Fulmer | F04B 43/1253 29/428 |
| 6,412,454 B1 * | 7/2002 | Green | F01B 1/062 123/54.1 |
| 2005/0201880 A1 * | 9/2005 | Gentilin | F04B 9/045 417/521 |
| 2013/0200207 A1 * | 8/2013 | Pongratz | B64C 39/024 244/2 |

OTHER PUBLICATIONS

Burwell, Daniel, Written Opinion of International Searching Authority for PCT/CA2016/050393, dated Jul. 28, 2016, 4 Pages, ISA/CA, Gatineau, Quebec, Canada.
Supplementary European Search Report in respect of corresponding EP patent application No. EP16775976, dated Oct. 17, 2018, 8 Pages, European Patent Office, Munich, Germany.

* cited by examiner

C

DRIVE SYSTEM FOR CHEMICAL INJECTION PUMPS AND INSTRUMENT AIR COMPRESSORS

CROSS-REFERENCE TO RELATED APPLICATIONS

This application is a national phase entry application of the International Patent Application No. PCT/CA2016/050393, which application claims priority to U.S. Provisional Patent Application No. 62/145,121 filed on Apr. 9, 2015 and U.S. Provisional Patent Application No. 62/300,626 filed on Feb. 26, 2016; the contents of all of the above applications being incorporated herein by reference.

TECHNICAL FIELD

The following relates to drive systems for chemical injection pumps having multiple fluid ends and for instrument air compressors, and to a drive system that can be interchanged between a pump and a compressor.

BACKGROUND

Natural gas wells and oil wells are often located in remote "off-grid" locations. Connecting these off-grid locations to normal electrical power distribution systems can be difficult and thus portable sources of power are often used, which may not be economical.

To ensure proper operation and prevent the formation of ice-like hydrates within the piping and valves connected to oil and gas wells (especially at pressure-drop locations such as the wellhead chokes), methanol is injected down-hole or upstream of the choke, free water is then removed (separated), and additional chemicals are injected by a pump or pumps. Other chemicals injected include corrosion inhibitors, scale inhibitors, paraffin inhibitors, biocides, emulsifiers, and others, as typically required in both natural gas and oil production. The use of chemical injection pumps in these remote locations is referred to as their "field use", or "use in the field".

When a well is brought online it immediately goes into what is called a "drawdown condition", which is an elevated level of production, and is the maximum that these wells will produce at any given time. During this time there is a requirement for proportionally greater chemical injection. It is therefore a requirement of injection pumps to inject the necessary the chemicals in remote off grid locations while also having capacity to address drawdown conditions.

Historically, pneumatic injection pumps have been used for the injection of these chemicals, and most injection pumps found in the field are still of the pneumatic injection variety. Pneumatic pumps are typically driven by one of two methods. The first method utilizes a conditioned production gas, wherein the gas is brought to a quality that can be used to drive pumps and instrumentation within the production unit (also be referred to as a "skid"). The second drive method uses bottled propane as a clean source of pressurized gas to drive instrumentation and pneumatic chemical injection pumps. To address drawdown conditions, the current standard in the field is to use a high volume pneumatic pump typically driven by propane. This propane is brought to the well-head in a liquefied form and then vaporized when used to drive the pump. However, after this gas has been used to drive the equipment in the skid, the used gas cannot be recaptured without extraordinary effort and expense, it is therefore vented to the atmosphere. Data suggests that pneumatic chemical injection pumps may be responsible for 60-85% of gas vented from skids. In addition to this resulting in wasted gas, the vented gas is harmful to the environment with data suggesting up to 19 times the carbon footprint of $CO_2$.

The above environmental concerns have led to the use of alternate power sources for the chemical injection pumps, notably solar power. Though solar powered pumps have higher initial cost for implementation, they can have favourable payback periods due to the elimination of wasteful gas. However, the reliability of solar powered systems can be poor in these remote well-site conditions, and the cost associated with malfunctioning pumps and associated downtime is high. For example, if the solar powered pumps malfunction, a high producing well may freeze due to a lack of methanol injection. Bringing a high producing well back online after such freezing is costly.

Currently two forms of rotational solar powered chemical injection pumps are found in field use: either a high-speed or a variable-speed solar powered injection pump.

High-speed pumps are the most commonly used solar pumps in the field primarily because of their low cost. These pumps operate at one continuous speed and have two states, a full-speed state and a stopped state, for example, using a 12-volt motor connected to a small offset cam drive with the motor mounted horizontally and a cam drive spinning vertically. The stroke of the pump delivers a few cubic millimeters per stroke, but the stroke rate is equal to the rotational speed of the motor, which can be as high as 1750 rpm. Because of this high speed a substantial amount of chemical can be injected prompting the need to turn the pump on and off continuously. However, cycling the electric motor from an off state to a full speed state in this way induces inrush electrical current.

In the case of electric motors with one speed, inrush can be 10 to 30 times the steady state running conditions. For solar powered pumps this is damaging to the life of the batteries used to drive the equipment. As the temperature in the field drops, the temperature of the batteries also drops and suppresses the chemical reaction required for the batteries to deliver their rated amp output. The effect of inrush on batteries in low temperature conditions results in a significant drop in deliverable amp hours, which represents a proportionate drop in system design autonomy. For example, automotive batteries, which are the most commonly used in the field, are routinely damaged due to inrush and a large number of them are sent to be recycled, resulting in high operational costs.

Using a variable speed solar powered injection pump addresses the inrush issue. For instance, using a 3-phase 24 VDC variable speed motor can eliminate the inrush. However, the only products currently available are expensive and limited in their capacity to drive multiple fluid ends. This in turn results in a smaller volume output from the pumps, limiting its effectiveness in the field especially during drawdown conditions.

Current designs are also found to be limited in their ability to drive multiple fluid ends. Current pump designs with more than two fluid ends are seen to suffer from a significant drop in deliverable pressure and/or volume when compared to a single fluid end. This in turn limits the amount of chemical that can be injected per cycle from currently available injection pumps.

There exists a need for a cost effective and reliable chemical injection pump capable of meeting drawdown conditions to serve as an alternative to the above stated examples currently in field use. There is a further need for an economical and reliable chemical injection pump with a reduced carbon footprint, and which can reduce or eliminate the gas being vented to the atmosphere.

SUMMARY

A drive system is described herein for various driven devices such as pumps and compressors. The drive system aligns four outputs in the same plane and delivers the required torque to each quadrant in the plane with no compromise in the deliverable thrust to any quadrant. A drive motor is coupled to the drive system above or below the plane in which the outputs are driven and multiple drive system units can be stacked to provide multiples of the four outputs.

In one aspect, there is provided a drive system that is interchangeable between driving fluid ends for pumping a fluid and for driving cylinders for vapor compression, the drive system being powered by a electrical motor and being configured to drive four outputs, each output being positioned in a radially separated quadrant, with the four outputs being positioned on a same plane; and a linkage at each output, the linkages being configured to be connected to either or both fluid ends and cylinders to drive same.

In another aspect, there is provided a drive system that can be adapted for multiple uses, such as a chemical injection pump or an instrument air compressor. The drive system can be made interchangeable such that the chemical injection pump can be converted to an instrument air compressor and vice versa. The drive system comprises: four outputs, each being positioned in a radially separated quadrant, the four outputs being positioned in a same plane.

In yet another aspect, there is stacked an additional drive system comprising: a first set of four outputs, each being positioned in a radially separated quadrant in a first plane; and a second set of four outputs, each being positioned in a radially separated quadrant, the four outputs in the second set being positioned in a second plane; wherein the first set and the second set are radially offset from each other to provide eight uniquely directed outputs.

In yet another aspect, there is provided a fluid end for an injection pump connected to the drive system, the fluid end comprising: a piston; an inlet; an outlet; a threaded vent; and a manual primer for priming the fluid end.

In yet another aspect, there is provided a fluid injection pump comprising: an electric motor powered by an electrical power source; a drive system powered by the electric motor, the drive system configured to drive four outputs each being positioned in a radially separated quadrant, the four outputs being positioned in a same plane; and a fluid end connected to each of the four outputs to intake and deliver a fluid from a fluid supply for use in injecting the fluid into a target structure.

In yet another aspect, there is provided a drive system for a chemical injection pump, the drive system comprising: four outputs, each being positioned in a radially separated quadrant, the four outputs being positioned in a same plane.

In yet another aspect, there is provided an air compressor comprising an electric motor powered by an electrical power source; a drive system powered by the electric motor, the drive system configured to drive four outputs, each positioned in a radially separated quadrant. The four outputs are positioned in a same plane, and a compressor cylinder is connected to each of the four outputs to intake and compress air from an air supply for use in supplying a target structure.

In yet another aspect there is provided a compressor cylinder for an air compressor. The cylinder comprises a piston with intake valves built-in, a circumferential piston seal, a piston cylinder and a compressor cylinder head with outlet valve. Alternatively, both intake and discharge valves may be in the cylinder head.

In yet another aspect, there is provided a drive system for an air compressor, the drive system comprising: a first set of four outputs, each being positioned in a radially separated quadrant, the four outputs in the first set being positioned in a first plane; and a second set of four outputs, each being positioned in a radially separated quadrant, the four outputs in the second set being positioned in a second plane; wherein the first set and the second set are radially offset from each other to provide eight uniquely directed outputs.

In yet another aspect, there is provided a piston assembly for compressing air in a cylinder, the piston assembly comprising a piston connectable at one end to a drive linkage for driving the piston within the cylinder, and a flapper valve connected at the other end of the piston, the piston comprising at least one passage to permit atmospheric air to lift the flapper valve on a suction stroke, each passage comprising an actuation area adjacent the flapper valve to contribute to lift of the flapper value during the suction stroke.

BRIEF DESCRIPTION OF THE DRAWINGS

Embodiments will now be described by way of example achieved with reference to the accompanying drawings in which.

The various features will become more apparent in the following detailed description in which reference is made to the appended drawings.

DETAILED DESCRIPTION OF THE INVENTION

A planetary drive system is provided for a pump or compressor, defining potential enemy storage devices as conventionally understood in the art, that aligns four fluid ends for the pump or cylinders for the compressor in the same plane and delivers the required torque to each quadrant in the plane with no compromise in the deliverable thrust to any quadrant. The fluid ends or cylinders thus arranged do not suffer from a decline in output pressure when compared to reciprocally driven systems. For example, in a chemical injection pump configuration, the fluid ends do not suffer from such a decline in output pressure when compared to fluid ends used in previous chemical injection pumps, wherein any more than two fluid ends suffers from a significant drop in deliverable pressure, e.g., up to 50%. Moreover, the planetary drive system and fluid end/cylinder arrangement described herein are stackable to allow, for example eight, twelve, or other multiples of fluid ends or cylinders to be driven while minimizing any reduction in output pressure. A chemical injection pump for a chemical injection system is therefore also provided which includes the above-noted drive system, and may also include threaded vents on the fluid ends to enable a cap to be threaded onto the threaded vent to capture chemicals primed through the valves avoiding spillage and waste as described more fully below.

It has also been recognized that the above-noted drive system that aligns four outputs for driving fluid ends for a pump can be converted to, or otherwise be used to construct a solar-powered air compressor (e.g., for supplying instrument air), with all four cylinders on a single plane without compromising pressure in any quadrant. The drive system can thus be paired with pistons having enhanced vacuum actuation under a flexible inlet, i.e. a flapper inlet as shown herein and described below.

Chemical Injection Pump and Drive System Therefor

Figure 1:
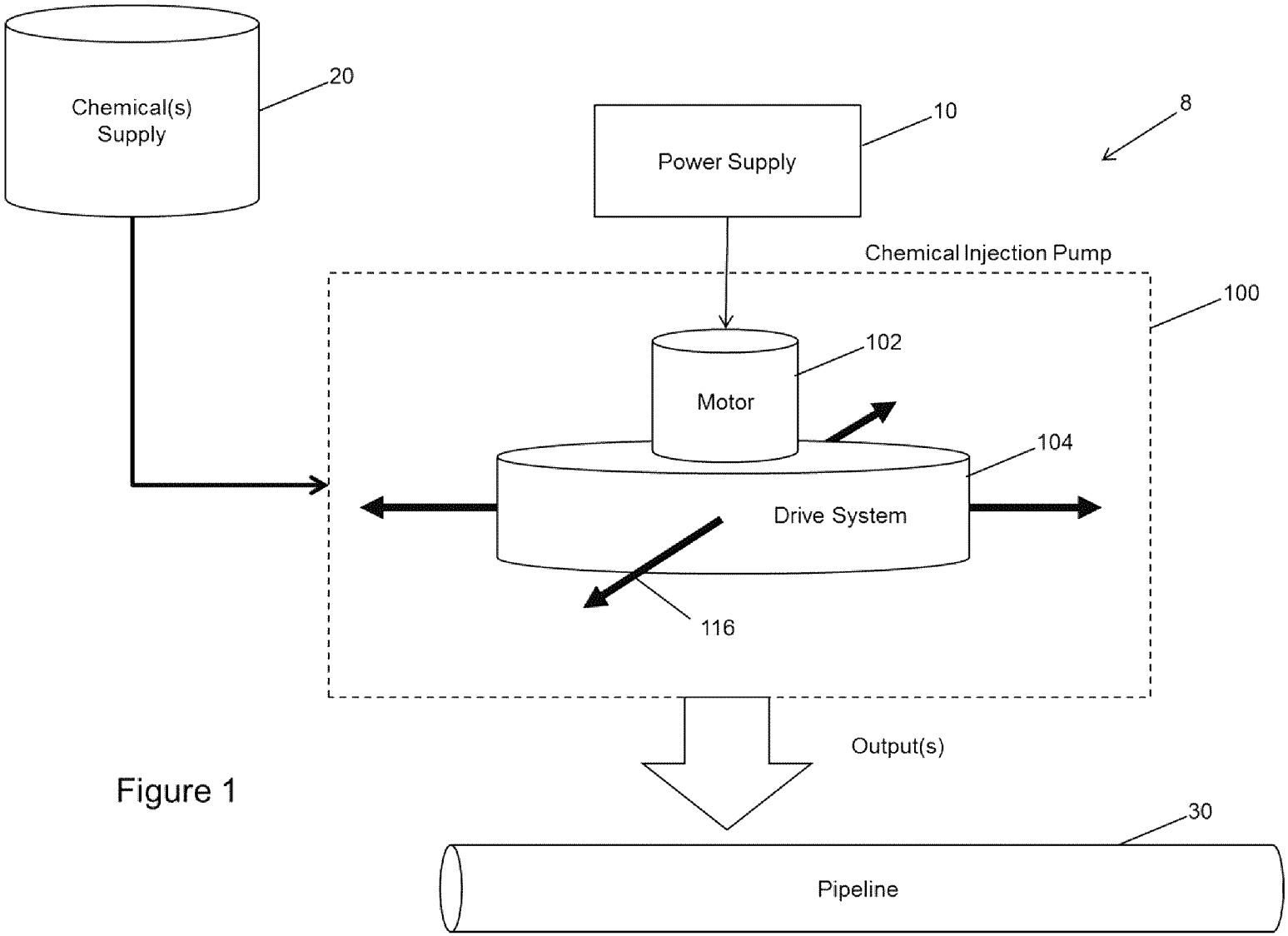
FIG. 1 shows a chemical injection pump in field use.

Turning now to the figures, FIG. 1 schematically illustrates a chemical injection system 8. The system 8 includes a power supply 10, which is used to power a chemical injection pump 100. The power supply 10 can be any available electrical power source, and the examples described herein include solar power generated from photovoltaic (PV) panels to serve as power supply 10. Other possible sources of power include power generated from a grid connection, fuel cells, an electricity generator, etc. The pump 100 has an electric motor 102, which is powered by the power supply 10 and drives a "drive system" denoted by numeral 104 via a transmission. The motor defines a prime mover of the chemical injection system, as conventionally understood in the art. The drive system 104 operates four fluid ends 116. As noted above, the drive system 104 can be stacked to provide eight, twelve or other multiples of fluid ends 116 driven by a suitably paired motor 102.

A chemical supply 20 supplies chemicals to the injection pump 100. The chemical supplied by the chemical supply 20 can be one or more types of chemical and the pump 100 is capable of pumping the same or different chemicals through the fluid ends 116. For example, the chemical supply 20 may contain methanol or other chemicals such as corrosion inhibitors, scale inhibitors, paraffin inhibitors, biocides, emulsifiers, etc., as typically required in both natural gas and oil production. The chemical supply 20 and pipeline 30 being serviced can differ for each respective fluid end 116. In the exemplary embodiment the pipeline 30 is an oil and gas pipeline but other pipelines requiring chemical injection may be serviced using the system 8.

The fluid ends 116 (see FIG. 2*a*) intake chemicals from chemical supplies 20 and injects the chemicals into a pipeline 30. The fluid ends 116 include a threaded vent 130 and a manual priming valve 128. The threaded vent 130 inhibits chemical loss when priming the corresponding fluid end by means of capturing chemical in user-provided containers for a later return to its original reservoir.

Figure 2A:
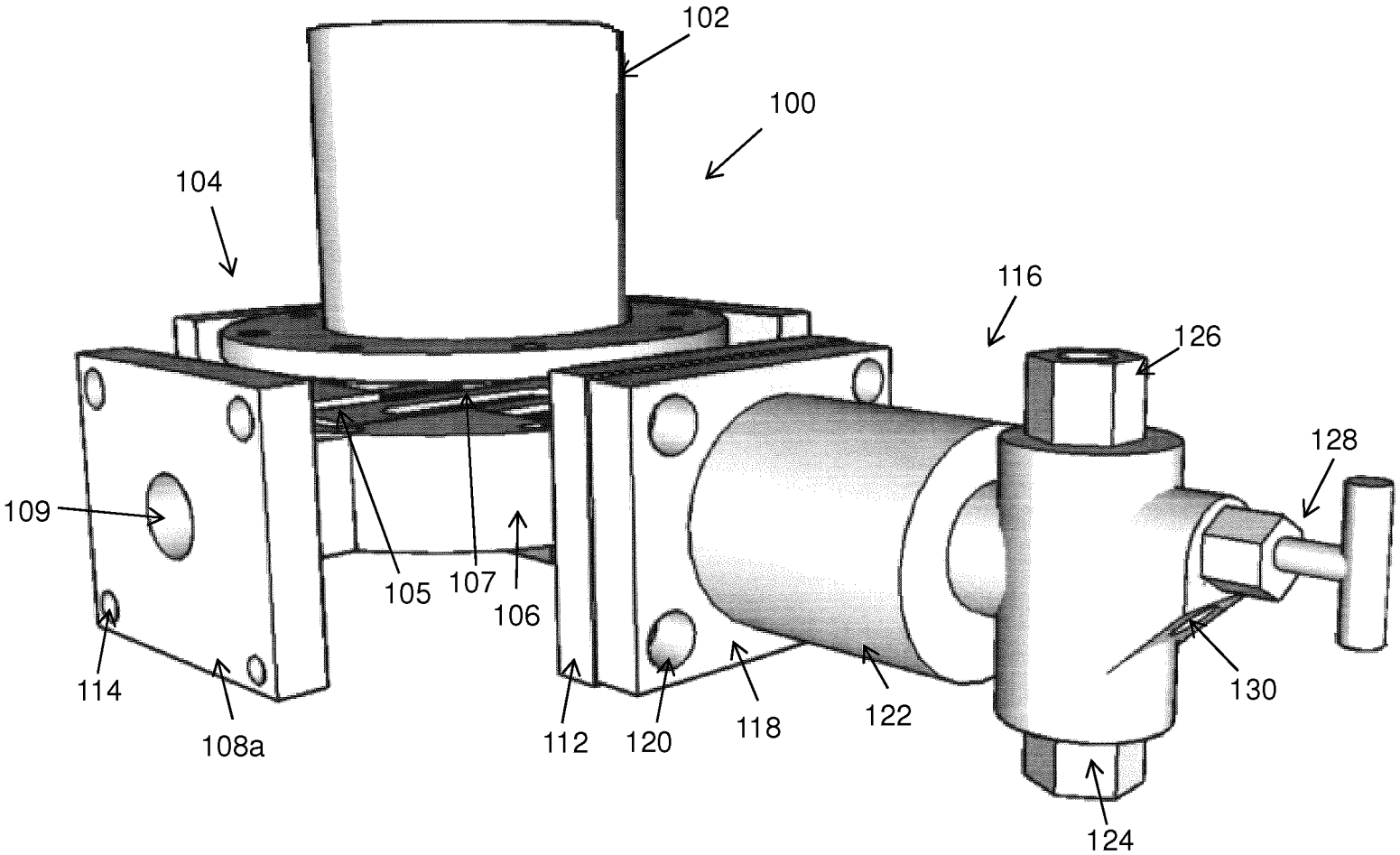
FIGS. 2*a* to 2*c* show perspective views of the chemical injection pump of FIG. 1.
Figure 3:
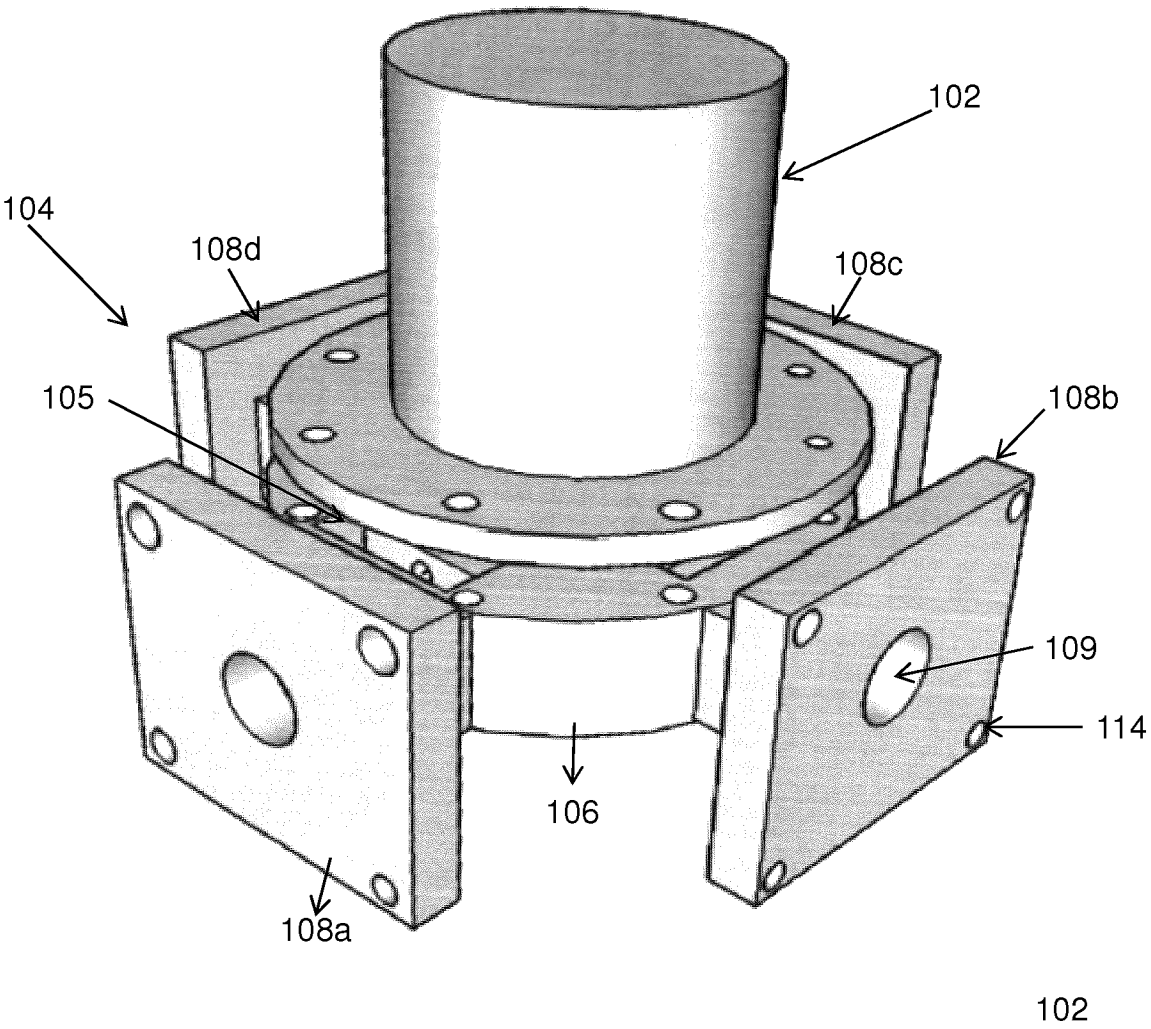
FIG. 3 shows a perspective view of a motor and drive system of the pump shown of FIG. 1.

As shown in FIGS. 2*a* and 3, the motor 102 is connected to the multi-headed drive system 104. The motor 102 can be a 3 phase 12 or 24 VDC or 120 or 240 volt AC electric motor, for example. The drive system 104 houses a transmission 105 in a chamber 107 within a transmission housing 106. This can also be seen clearly in FIG. 4. The transmission housing 106 has four outputs, denoted by 108*a*-108*d*, each output 108 extends out of each of four sides and can include a mounting flange 112. A central aperture 109 extends through the flange 112. A hole 114 is disposed near each corner of the flange 112. The holes 114 provide a means to connect the output 108 with surfaces such as other flanged ends using fasteners such as bolts. Although shown as a square shaped flange 112, the flange 112 may have other profiles such as a circular profile.

The drive system 104 connects to a respective fluid end 116 through each of its outputs 108. A flange 118 on the fluid end 116 is similar to flange 112 at each output 108 and has holes 120 to permit the use of fasteners such as bolts. Hence, bolts can be used with the holes 120 and 114 to securely connect the fluid end 116 to the drive system 104. Additionally, a gasket may be interposed between the flange 112 and fluid end flange 118 to create a tighter seal there between and inhibit the leaking of fluid.

The fluid end 116 includes a piston chamber 122 (FIG. 7*b*), a suction line 124 to intake fluid from a chemical supply 20, a discharge line 126 to output chemical to be injected into the pipeline 30, a manual priming valve 128 and a threaded vent 130. The fluid end 116 is attached to the output 108 in a manner wherein the central aperture 109 aligns with the piston chamber 122.

Figure 2B:
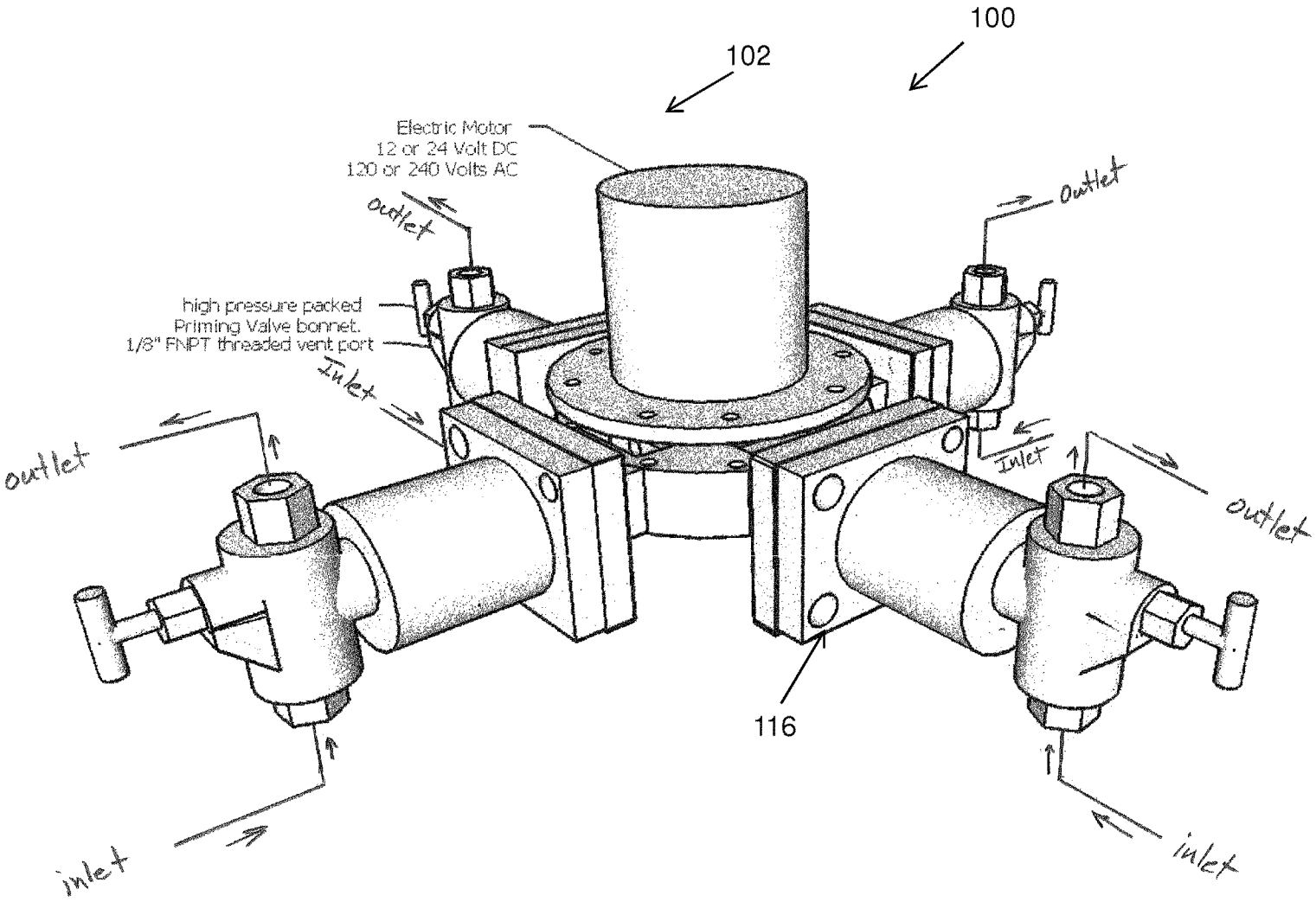
Figure 2C:
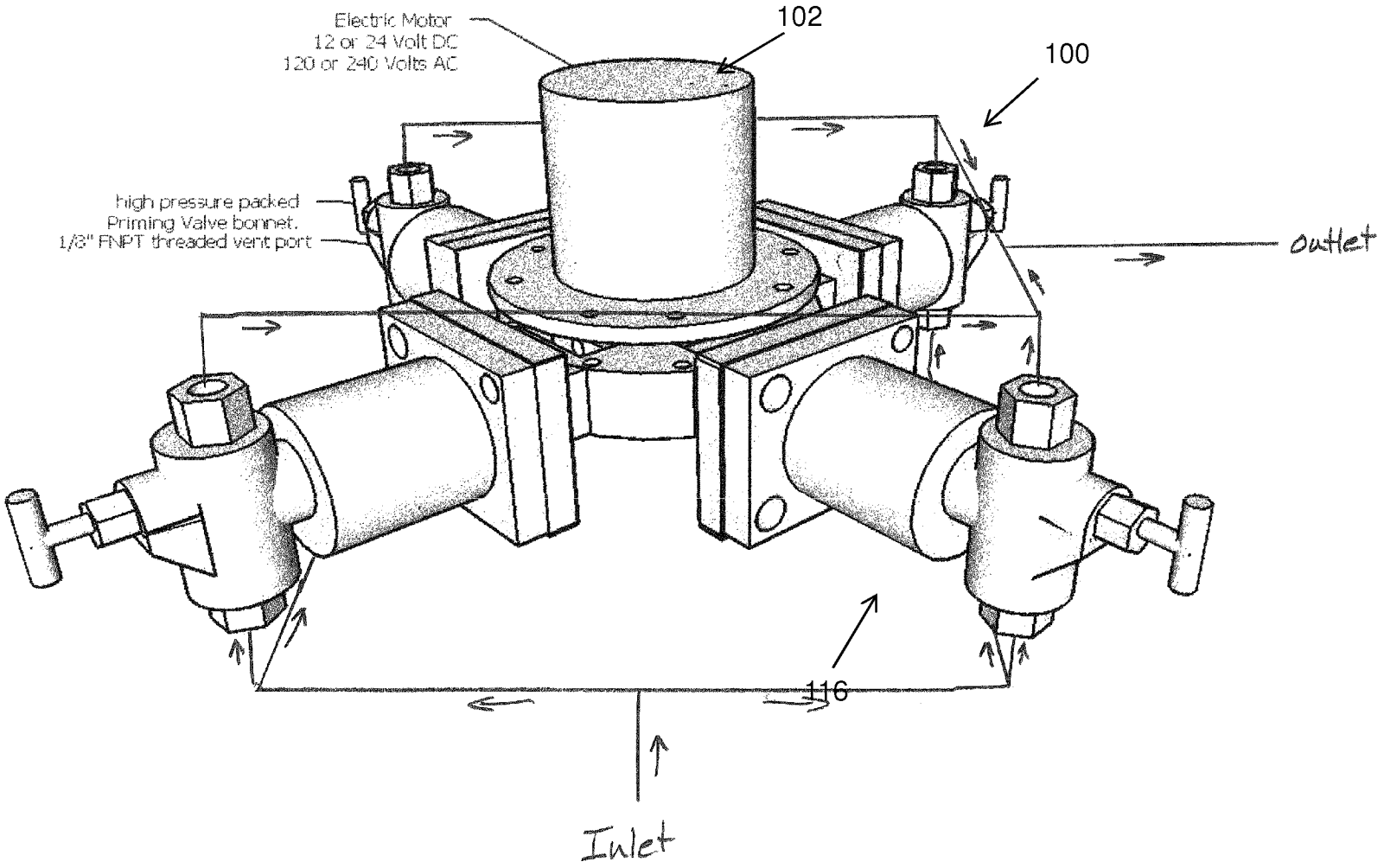

As discussed above, the pump 100 may be used to inject different chemicals through each fluid end 116, or can inject the same chemical through multiple fluid ends 116. For example, FIG. 2*b* illustrates a configuration in which four different chemicals are pumped through respective fluid ends 116 and FIG. 2*c* illustrates a configuration in which each of the four fluid ends 116 pumps the same chemical and thus share a common inlet and outlet path respectively.

Figure 4B:
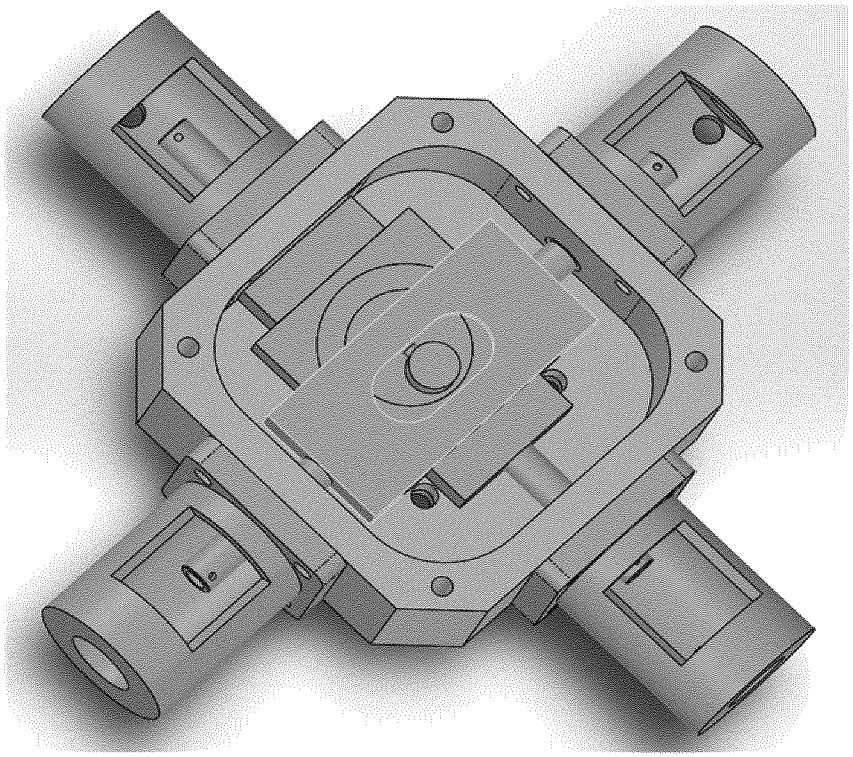
FIGS. 4*a* and 4*b* show top views of different casing configurations for the drive system of FIG. 1.
Figure 4A:
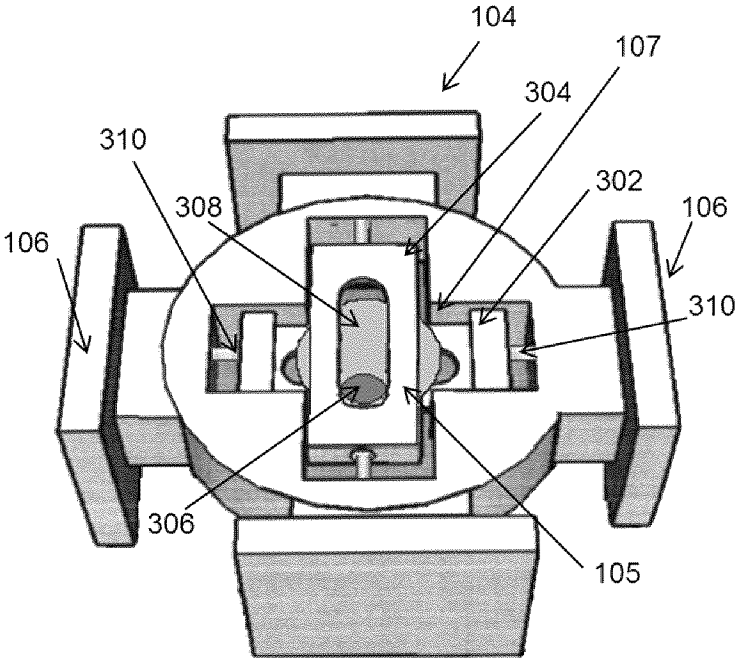
Figure 5:
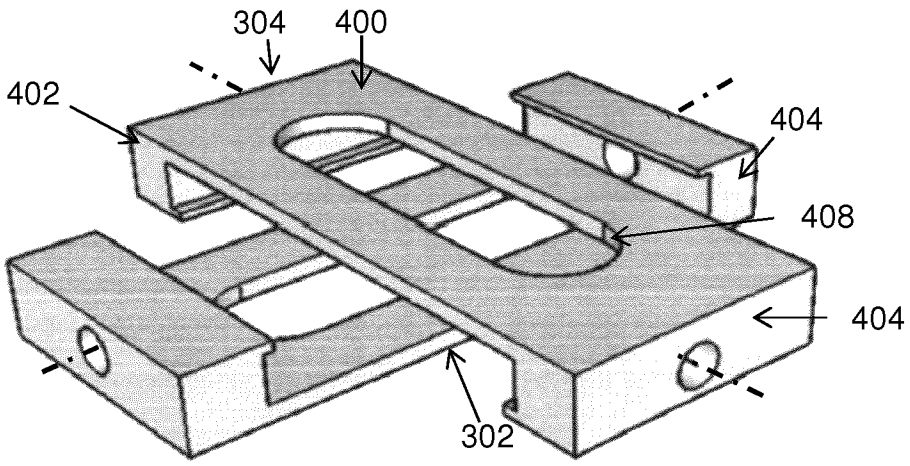
FIG. 5 shows a perspective view of slotted members used in the transmission of the output drive system shown in FIG. 4.

FIGS. 4 and 5 illustrate the components of the drive system 104 in isolation. The chamber 107 houses the transmission 105, and the transmission 105 includes a cam wheel 308 connected to a shaft 306. The shaft 306 is attached to the motor 102 and joins the cam wheel 308 near the outer edge of the wheel 308, resulting in eccentric motion for the cam wheel 308. The transmission 105 also includes a pair of slotted members 302 and 304, each slotted member having a linkage 310 in the form of a shaft at each end to connect to a piston in the piston chamber 122 of the corresponding fluid end 116.

Each slotted member 302 and 304 has a rectangular base 400 including a respective slot 408 for receiving a portion of the shaft 306 protruding from the cam wheel 308. Rotation of the shaft 306 is within the slots 408 and constrains movement of the corresponding slotted member 302, 304 within the chamber 107 when bearing against the ends of the slots 408. The opposing ends of the bases 400 on each slotted member 302, 304 have flanges that provide cam wheel surfaces 402 and 404, which as shown in FIGS. 6*a*-6*d* are located in a rotational plane of the cam wheel in opposite relation to the cam wheel, against which the cam wheel 308 engages during rotation. These cam wheel surfaces 402, 404 allow for engagement with the cam wheel 308 wherein the cam wheel 308 bears against the surface 402, 404 corresponding to the fluid end 116 being driven at that time.

The slotted members 302, 304 are positioned perpendicular to each other such that each arm of the cross-shaped chamber 107 houses one slotted member. The slotted members are shorter in length than the length of each respective arm of the chamber 107 in which they are placed, and therefore the slotted member 302 and 304 are capable of translational reciprocal motion within the chamber 107. Consequently, four drive directions are provided in the same plane, driven by the planetary movement of the cam wheel 308.

The rotation of the cam wheel 308 which causes the multiple fluid ends 116 to be driven is shown in FIGS. 6*a*-6*d*. The shaft 306 is fixed to the wheel 308, transfers rotary motion from the motor 102 to the cam wheel 308. The slotted members 302 and 304 interpose the cam wheel 308 between them, with the flanges providing the cam wheel surfaces 402, 404 extending towards each other to enable the cam wheel 308 to engage each of the surfaces 402, 404 in turn. As noted above, the cam wheel 308 has an eccentric motion due to the attachment of shaft 306 near the outer edge of the cam wheel 308 and this causes a larger portion of the cam wheel 308 to bear against each surface 402, 404 in succession and drive the corresponding fluid end 116 in each quadrant. As more clearly shown in FIG. 6*a*, the cam wheel surfaces 402 of each reciprocating slotted member 302, 304 are planar and are oriented tangentially to the periphery of the cam wheel which is circular in shape. Furthermore, as more clearly shown in FIG. 6*a*, the cam wheel surfaces 402 of each reciprocating slotted member 302, 304 are oriented orthogonally to the drive direction of the slotted member.

Figure 6A:
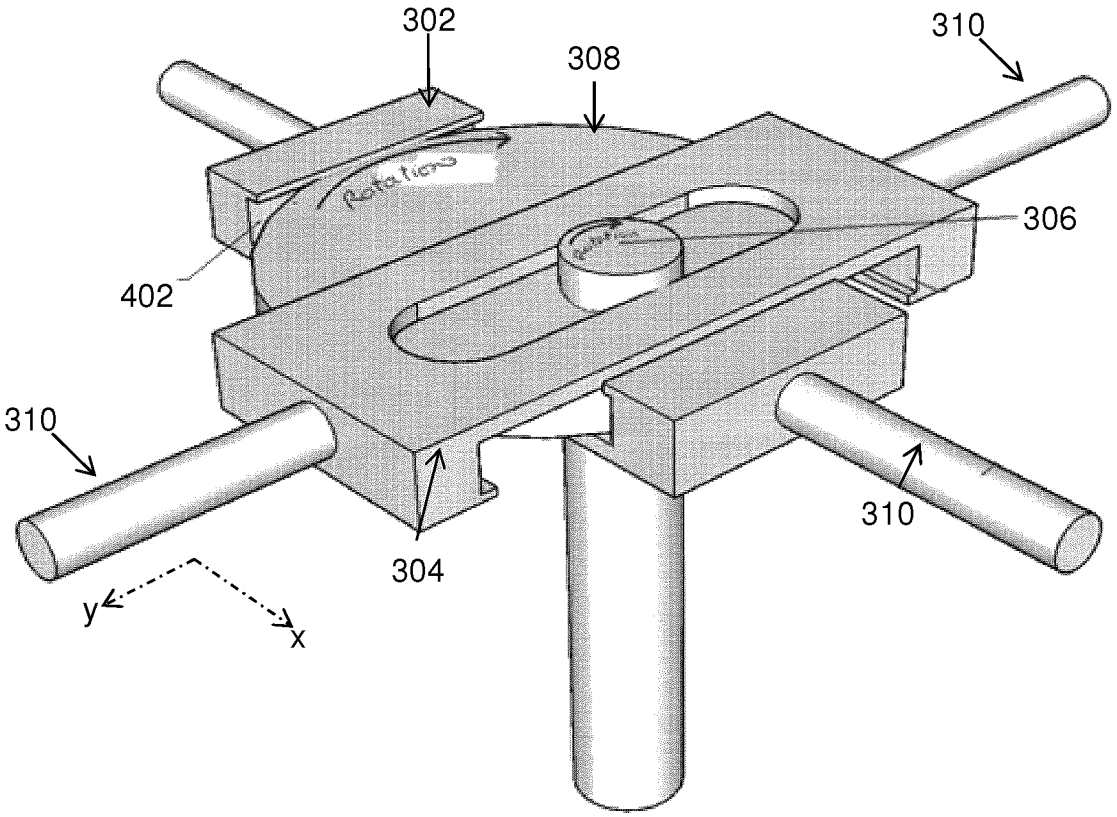
FIGS. 6*a* to 6*d* show the various configurations of the transmission of output drive system shown in FIG. 2.
Figure 6B:
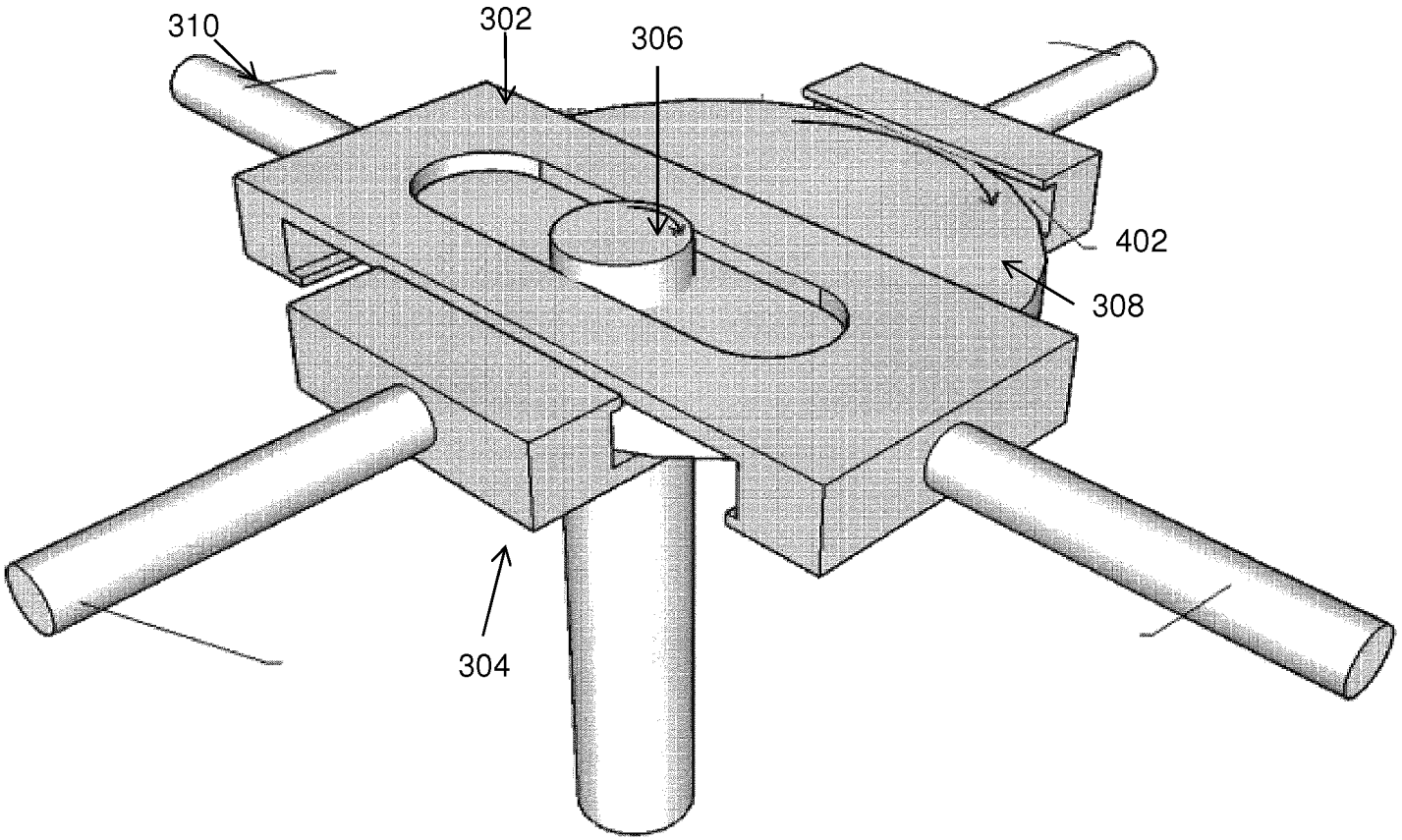
Figure 6C:
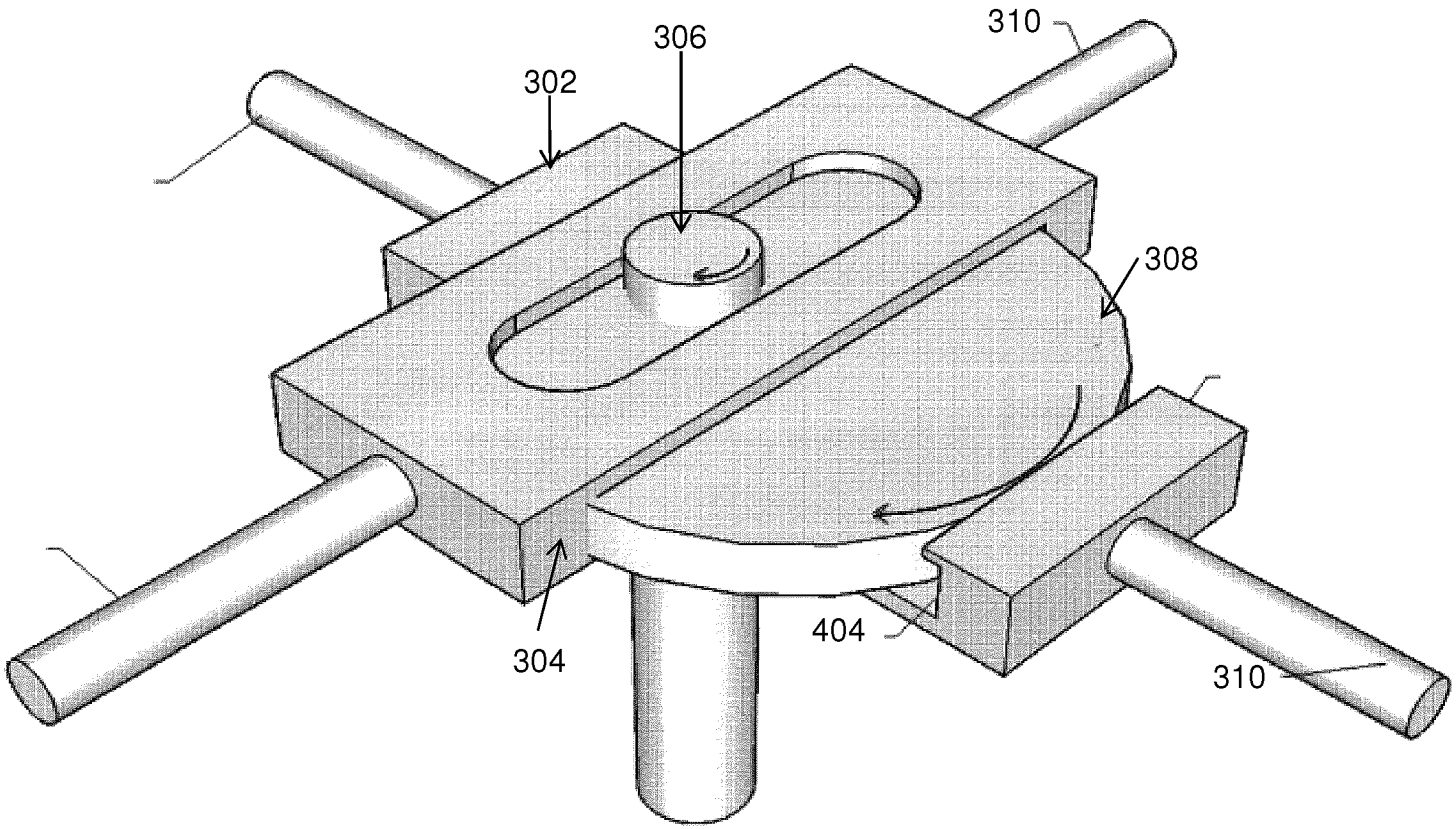
Figure 6D:
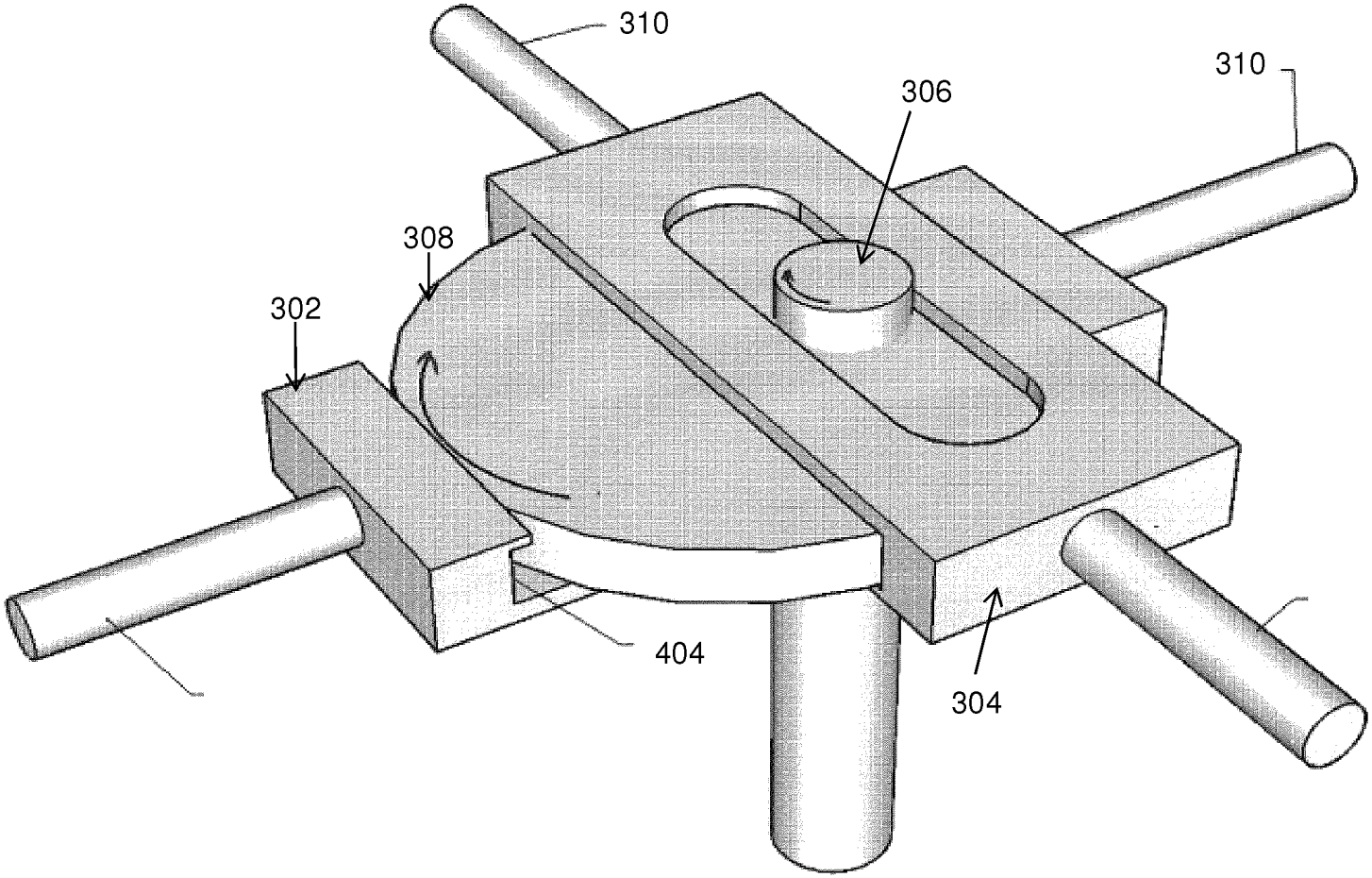

As seen in FIG. 6*a*, during rotation of the motor the slotted member 302 is driven in one direction towards a fluid end 116. This movement drives a piston to a discharge state wherein the pump fluid end 116 will have injected chemical into the pipeline 30. A piston connected to the other end of the same slotted member 302 is driven into a suction state, in which the connected fluid end 116 intakes fluid from the chemical source 20.

As the cam wheel 308 continues to rotate, the same action is applied to the other slotted member 304 causing the next radially spaced fluid end to inject chemical while intaking chemical at the other end. At this time the other slotted member 302 is neutral. The planetary motion allows four fluid ends to be driven in the same plane in this manner without experiencing a drop in output pressure.

Figure 7B:
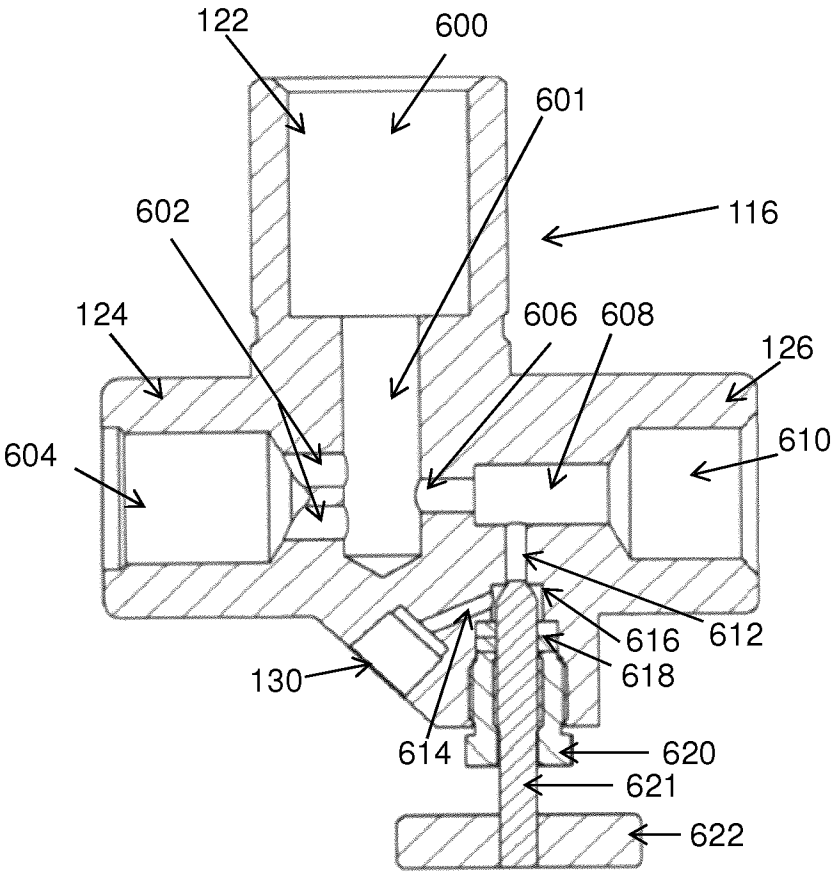
FIG. 7*b* shows a cross sectional view of the fluid end along the line A-A as shown in FIG. 7A.
Figure 7A:
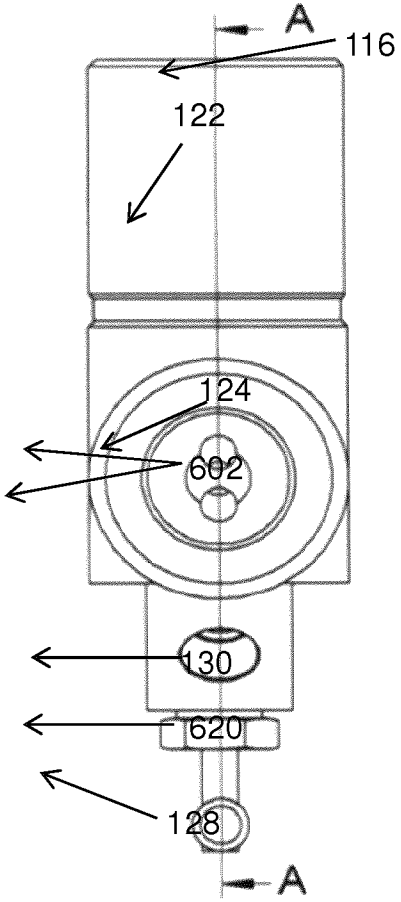
FIG. 7*a* shows a side view of a fluid end of the chemical injection pump of FIG. 1.

An example of a fluids end 116 that can be used with the system described herein is shown in greater detail in FIGS. 7*a* and 7*b*, wherein the fluid end 116 has a piston chamber 122 which comprises a piston bore 600 connected to a fluid chamber 601. The fluid chamber 601 is fluidly connected to the suction line 124 having a suction bore 604 via a suction passage 602. On the other end, towards the discharge line 126, the fluid chamber 601 is connected to a discharge bore 610 via a discharge passage 606.

The fluid end 116 further includes a priming passage 612 connected to an enlarged portion 608 of the discharge passage 606. The priming passage 612 is additionally connected to a vent passage 614; and the vent passage 614 is connected to a threaded vent 130. The threaded vent 130 prevents spillage of chemical by allowing a fitting cap to be threaded onto the threaded vent 130 and chemical released during the priming process can be captured in a user-provided container and returned to its holding reservoir. The connection between the priming passage 612 and the vent passage 614 is controlled through the manual priming valve 128. The manual priming valve 128 is a high pressure packed priming valve having a stem 621, a handle 622, and a high pressure adjustable packing nut 620. The high pressure packing 618 can be in the form of a gland nut with packing rings, such as O-rings to restrict the escape of fluid from around the priming valve stem 128. The valve stem 618 is normally in the closed position such that the stem 621 blocks the connection between the vent passage 614 and priming passage 612. However, upon displacement of the plunger 621 using the handle 622, the vent passage 614 becomes connected to the priming passage 612 through a priming bore 616.

During the suction cycle a piston passes through the packing chamber bore 600 (piston not shown) within the piston bore 601 and creates suction pressure within the fluid passage 601 and suction bore 602. Conversely, the piston causes a discharge pressure in the fluid passage 601 and the discharge bore 606 during the discharge state. In the suction state a discharge valve remains closed and a suction valve opens, drawing in the injection chemical from chemical source 20 through the suction bore 604/602. In the discharge state the discharge valve is open and suction valve closed, forcing the chemical out through the discharge bore 604 and out to be injected into the pipeline 30.

During the start-up of the pump, priming will be required. The pump can be manually primed by venting trapped vapor or force-primed, by connecting the vent 130 to a handheld manual chemical pump and turning the handle 622 counter clockwise to back out the plunger 621. This displacement allows the vent passage 614 to be the priming passage 612 allowing trapped vapour in the discharge passage 606/608/610 to be manually vented and ease pump initiation. Additionally, by opening the priming valve 128 chemical can be pumped into the threaded vent 130, the discharge passages 606/608/610 flooding the discharge line from the fluid end displacing any trapped vapour in the discharge line leading to the pipeline. This is the only design that allows for this procedure and will reduce commissioning time.

The priming valve 128 and threaded vent 130 can thus help eliminate chemical spills caused by the priming process and allow for recapture of chemical. The threaded vent 130 provides a secure means to connect to the fluid end 116 while the manual priming valve 128 adds a simple means to conduct the priming process. Historically, the fluid ends 116 have used unthreaded vent discharge ports and chemical is allowed to spill into a tray or on the ground, which is prevented using the presently described design.

It can be appreciated from the above that the entire rotational cycle of the motor's rotation is utilized to inject chemicals resulting in higher volume throughput per rotation to meet high volumetric demand such as at drawdown conditions. It can therefore be seen that it is possible to achieve a 90 degree separation between the beginning of one stroke and the end of the adjacent stroke throughout a 360 degree plane and effectively drive four outputs at a low rpm. The ability to use commercially available 3 phase motors allows a means to counter the issues related to inrush and thereby reduces the destruction of batteries used to support pumps in the field. The pump 100 will allow for less consumption of power than traditional rotary electric motor pumps. Surplus electric power produced may also be used for other local equipment, unrelated to the pump.

Figure 8:
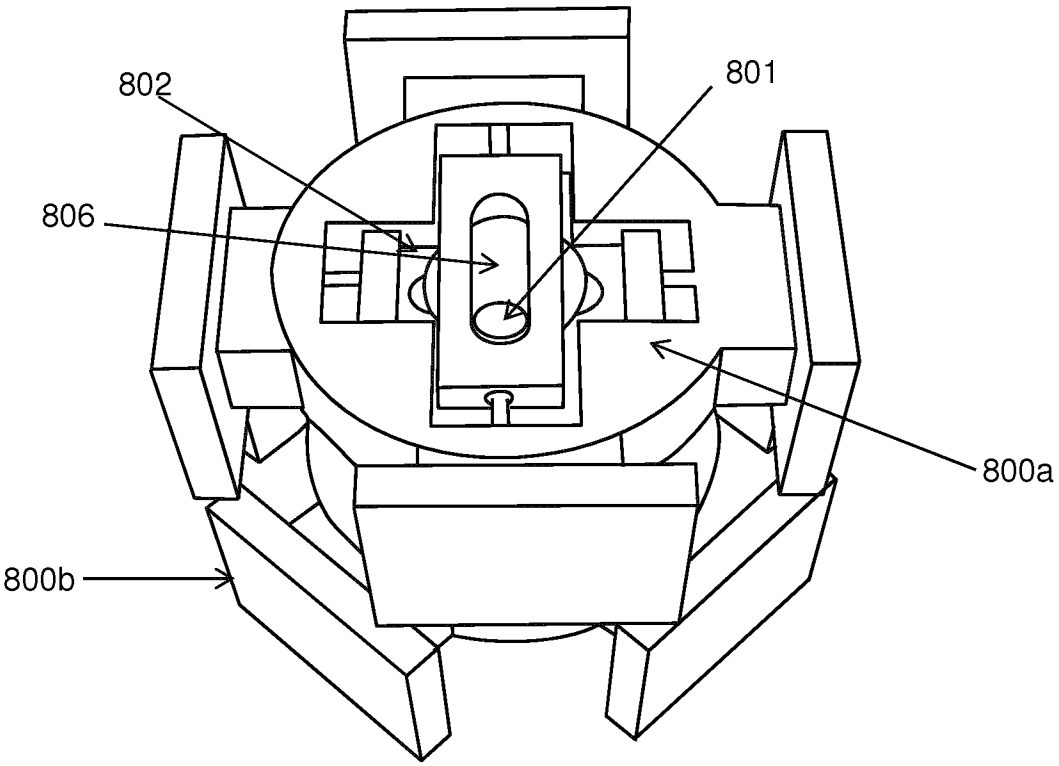
FIG. 8 shows a top view of a stacked drive system alternative to that shown in FIG. 4.
Figure 9A:
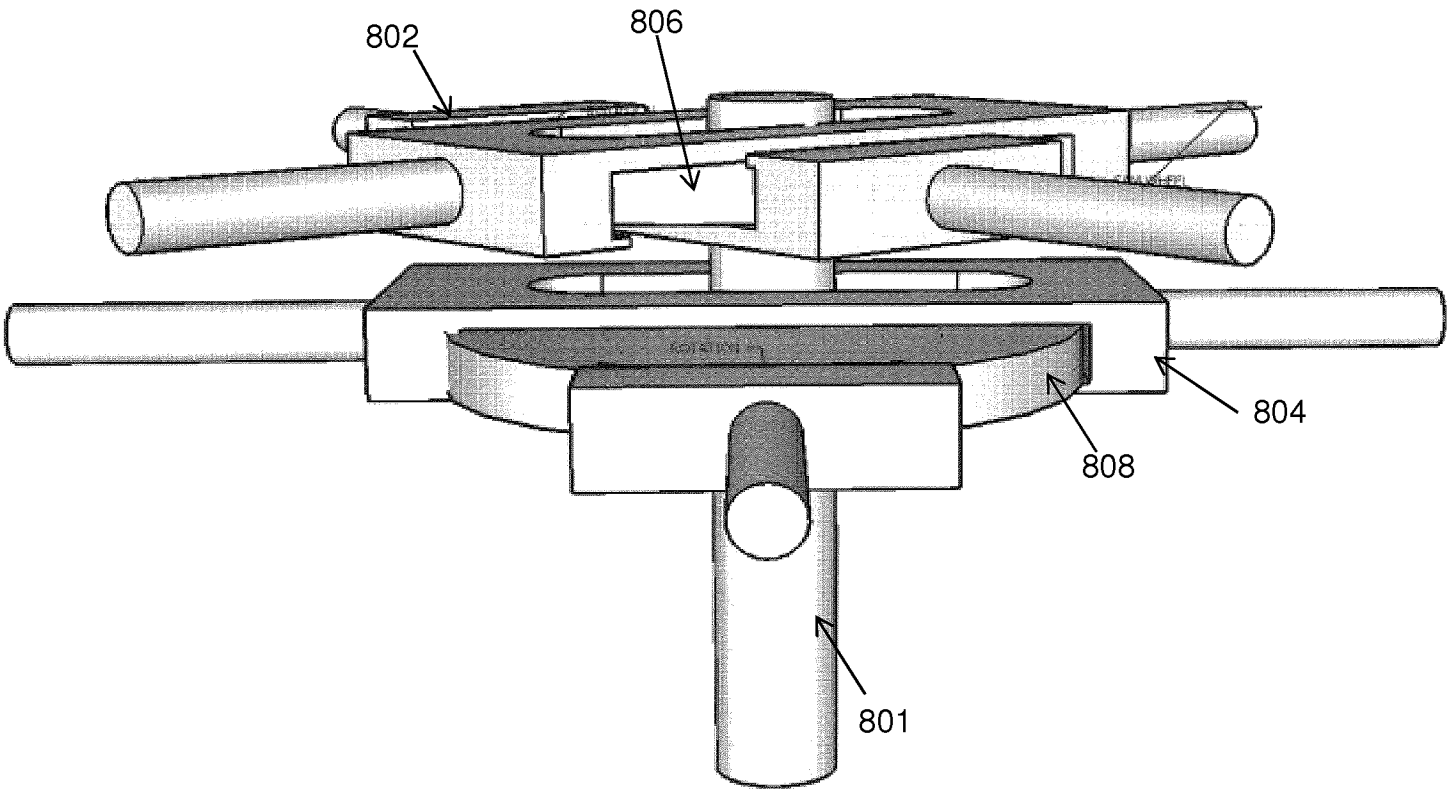
FIGS. 9*a* and 9*b* show embodiments of a transmission for the stacked drive system of FIG. 8.
Figure 9B:
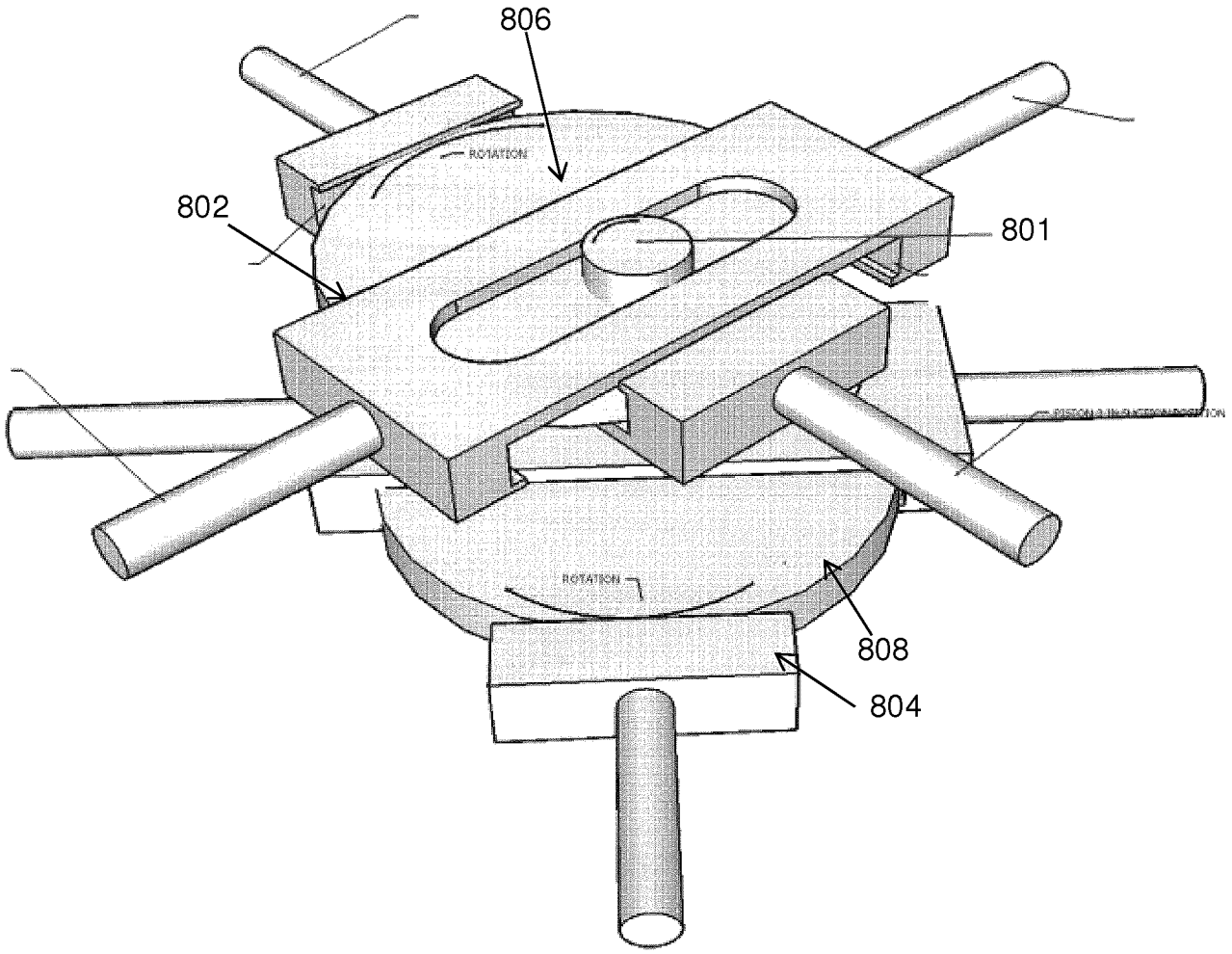

As discussed above, the planetary drive system in FIGS. 6*a*-6*d* is stackable as seen in FIG. 9*a* and therefore the number of fluid ends 116 being driven is scalable. For example, as shown in FIG. 8, a pair of drive systems 800*a* and 800*b* can be stacked and connected to the same output shaft of the motor 102. The drive systems 800*a* and 800*b* are rotationally offset from each other, e.g., such that each of eight fluid ends 116 are effectively offset by 45 degrees. By offsetting the cam wheels 308 (see FIGS. 9*a*-9*b*) in each drive system 800*a*, 800*b*, between fluid end strokes in one drive system 800*a*, a fluid end stroke occurs in the other drive system 800*b*.

In this arrangement the motor 102 can drive eight distinct outputs using one rotation. Thus the design allows for a scalable means for increasing the number of fluid ends 116 through a single motor 102.

Figure 10A:
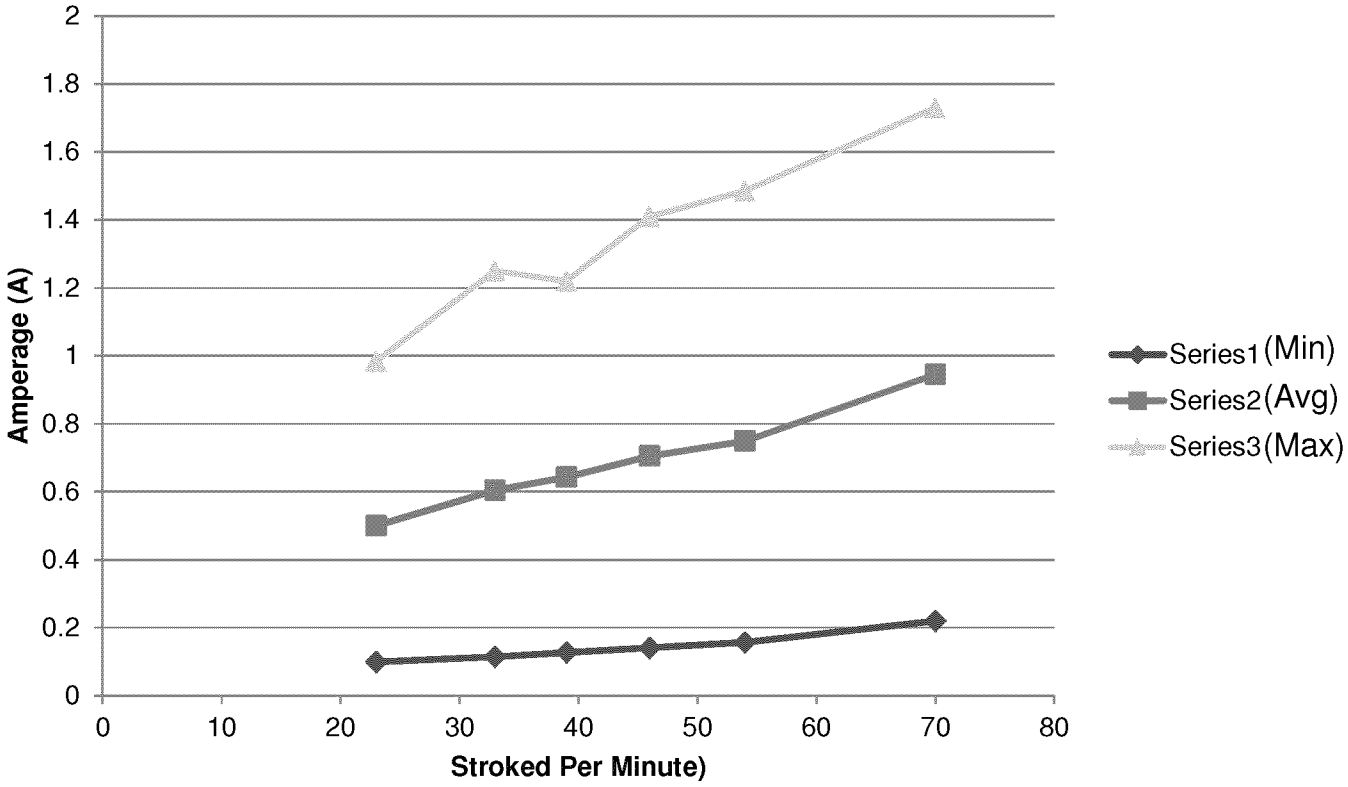
FIGS. 10*a* to 10*c* are graphs illustrating speed versus current draw at different pressures for a particular gear ratio.

During benchmark testing it was observed that the pump system 8 described herein was not impacted by inrush. This can contribute to a longer battery life and lead to less power consumption. For example, as shown in FIG. 10*a* and Table 1a below, for a 12.5 to 1 gear ratio, at 500 PSI, the minimum, average, and maximum amperage increases linearly as the strokes per minute increase. The increasing strokes do not cause a spike in current corresponding to inrush.

TABLE 1a

| Sample data for 500 PSI | | | | |
|---|---|---|---|---|
| | Strokes per minute | Min (Amps) | Avg (Amps) | Max (Amps) |
| 500 | 23 | 0.0989 | 0.5 | 0.983 |
| PSI | 33 | 0.114 | 0.605 | 1.25 |
| | 39 | 0.127 | 0.643 | 1.22 |
| | 46 | 0.141 | 0.705 | 1.41 |
| | 54 | 0.157 | 0.749 | 1.485 |
| | 70 | 0.22 | 0.945 | 1.73 |

Figure 10B:
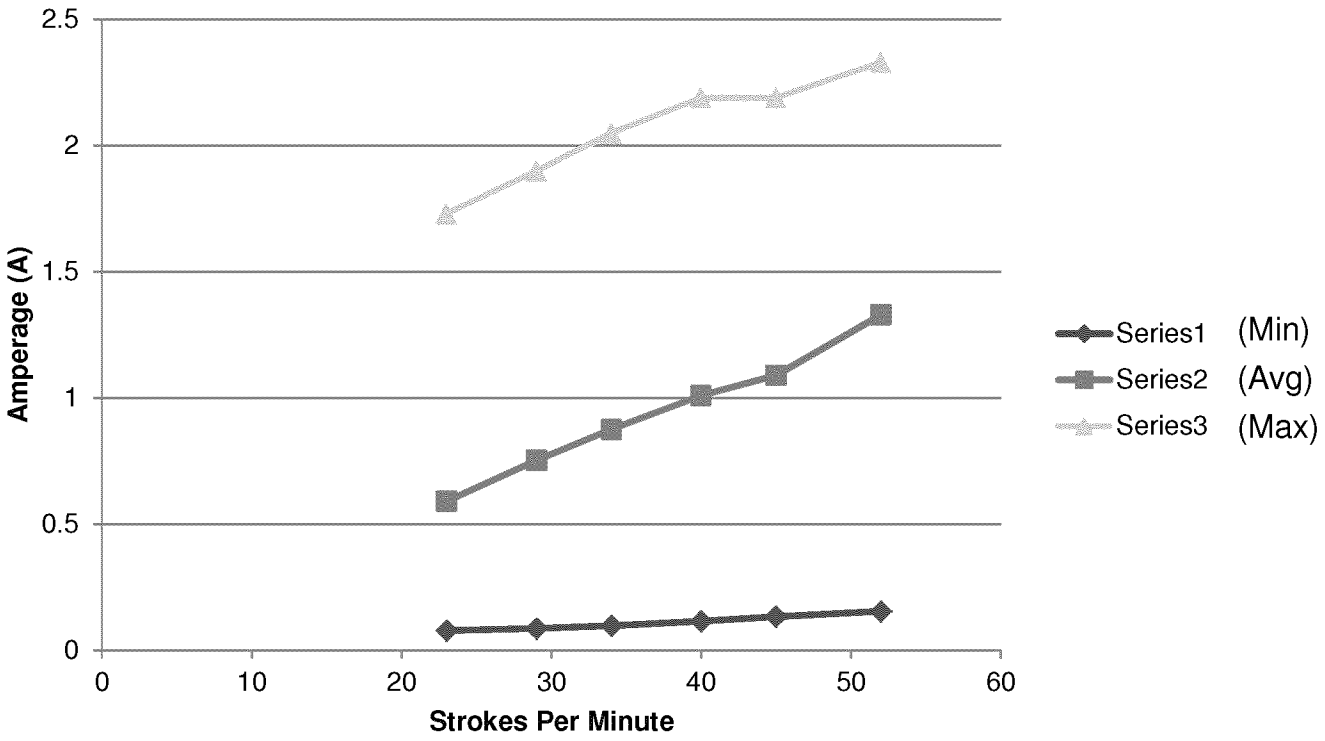

Table 1 b below and FIG. 10*b* illustrates that similarly for the 12.5 to 1 gear ratio, at 1000 PSI, the minimum, average, and maximum amperage increases linearly as the strokes per minute increase, i.e., without experiencing a spike in current corresponding to inrush.

TABLE 1b

| Sample data for 1000 PSI | | | | |
|---|---|---|---|---|
| | Strokes per minute | Min (Amps) | Avg (Amps) | Max (Amps) |
| 1000 | 23 | 0.0788 | 0.591 | 1.73 |
| PSI | 29 | 0.0873 | 0.753 | 1.9 |
| | 34 | 0.098 | 0.876 | 2.05 |
| | 40 | 0.116 | 1.01 | 2.19 |
| | 45 | 0.134 | 1.09 | 2.19 |
| | 52 | 0.155 | 1.33 | 2.33 |

Figure 10C:
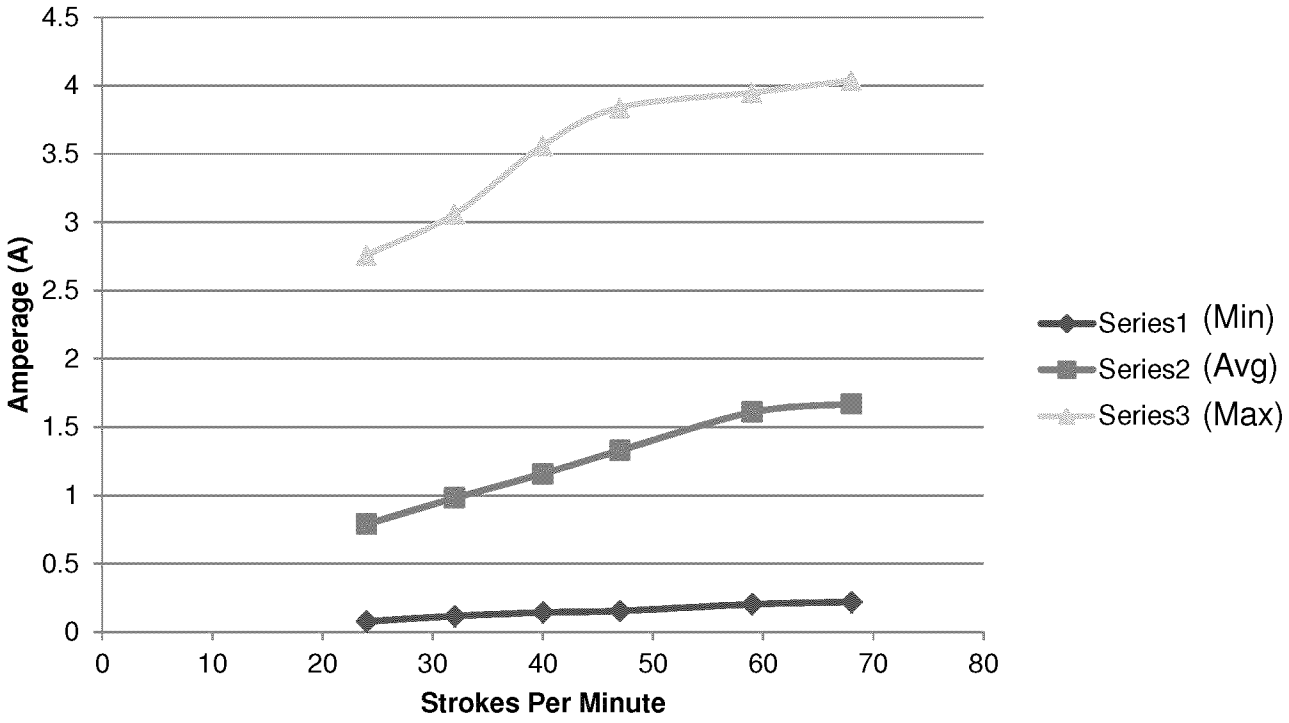

Table 1c below and FIG. 10*c* also illustrate the same effect at 1500 PSI.

TABLE 1c

| Sample data for 1500 PSI | | | | |
|---|---|---|---|---|
| | Strokes per minute | Min (Amps) | Avg (Amps) | Max (Amps) |
| 1500 | 24 | 0.0782 | 0.79 | 2.76 |
| PSI | 32 | 0.117 | 0.982 | 3.06 |
| | 40 | 0.144 | 1.16 | 3.56 |
| | 47 | 0.155 | 1.33 | 3.84 |
| | 59 | 0.204 | 1.61 | 3.95 |
| | 68 | 0.221 | 1.67 | 4.04 |

In other embodiments of the chemical injection system 8, the pump 100 can be configured to have or be coupled to a microprocessor based Supervisor Control and Data Acquisition system (SCADA) to provide control operations, and to monitor the status of the pump 100 in order to report on the performance of the pump 100.

It can be appreciated that the chemical injection pump 100 described herein can result in lower operating costs and contribute lower greenhouse gas emissions than the pneumatic pumps currently in field use. The system also allows for more reliable year-round operation. The pump 100 can be retro fitted with a higher voltage and amperage motor that can be driven by a portable power generator, which can be of solar or another form of power source. The inherent reduction in greenhouse gas emissions provided by adopting this technology can provide improved air quality, while helping users increase production of natural gas or oil.

Therefore, a chemical injection pump is provided, which is capable of driving multiple fluid ends in the same plane. The pump comprises an electric motor powered by an electric power source connectable to a drive system, and the drive system contains a transmission connecting the electric motor to a plurality of radially offset fluid ends, wherein the fluid ends each intake chemical from a chemical supply and output the chemical to a pipeline.

In another aspect, there is provided a drive system for a chemical injection pump wherein the drive system connects an electric motor to a plurality of fluid ends. The drive system comprising a transmission. The transmission includes an eccentric cam wheel connected through a shaft to the electric motor. The cam wheel drives a pair of perpendicularly arranged slotted members, each slotted member connected to a fluid end on each of its ends. The cam wheel converts a quarter rotation of the motor into linear motion for the slotted members such that each half turn of the motor causes discharge pressure in one fluid end and suction pressure in the piston connected on the other end of the same slotted member.

Convertible Air Compressor

In a further aspect, there is provided a fluid end for a chemical injection pump, wherein the fluid end comprising a suction line to intake chemical from a chemical supply, a discharge line to output the chemical to a pipeline, a threaded vent for priming and a manual priming valve.

As discussed above, the drive system can also be adapted to drive an instrument air compressor by coupling pistons with enhanced vacuum actuation under the flexible inlet. The drive system connects an electric motor to multiple cylinders. In the same configuration as the chemical injection pump, the drive system comprises a transmission that includes an eccentric cam wheel connected through a shaft to the electric motor. The cam wheel drives a pair of perpendicularly arranged slotted members, each slotted member is connected to a cylinder on each of its ends rather than a fluid end. The cam wheel converts a quarter rotation of the motor into linear motion for the slotted members such that each half turn of the motor causes discharge air pressure in one cylinder and suction pressure in the piston connected to the other cylinder of the same slotted member.

In a further aspect, there is provided a cylinder for a vapor compressor, wherein the cylinder comprising a suction line through the circumference of the cylinder takes in vapor through a filter discharge line to output the compressed vapor to be used in a variety of applications.

Figure 11:
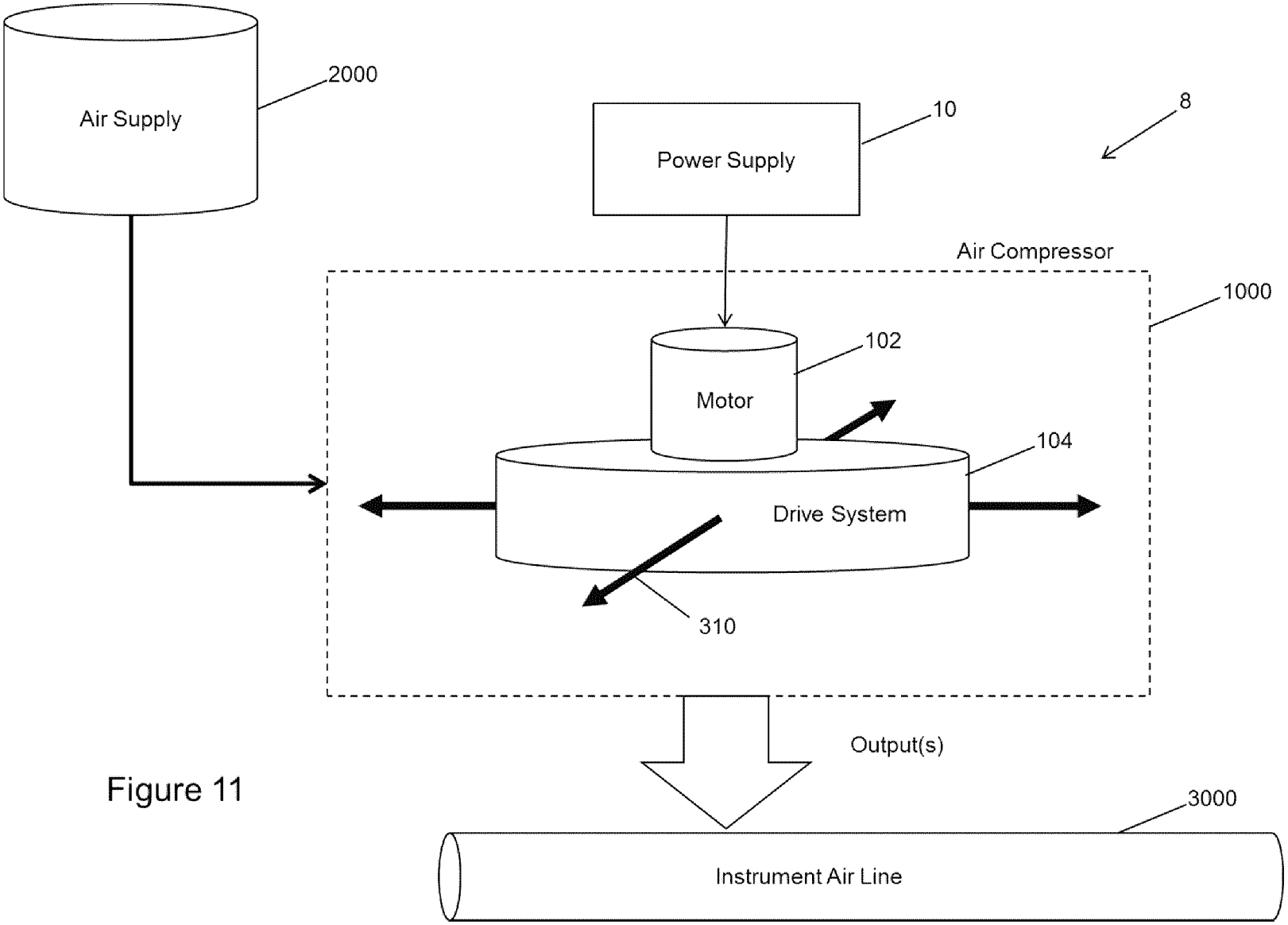
FIG. 11 is a schematic diagram illustrating the drive system shown in FIG. 1 adapted for use in driving an instrument air compressor for providing compressed air to an instrument airline.

FIG. 11 illustrates an alternative configuration to that shown in FIG. 1, in which air or vapor is supplied to or otherwise drawn by a compressor 1000 that comprises the drive system 104 described in detail above. In this example, an air supply 2000 feeds the compressor 1000, which drives four cylinders (see FIGS. 12-20 described below) to generate compressed air for an instrument air line 3000. It can be appreciated that the power supply 10, motor 102, drive system 104, and linkages 310 can be the same or substantially similar to that used for driving the chemical injection pump 100 described above and thus the drive system 104 can provide a "universal base" for driving various driven systems that utilize reciprocating elements such as pistons.

Figure 12:
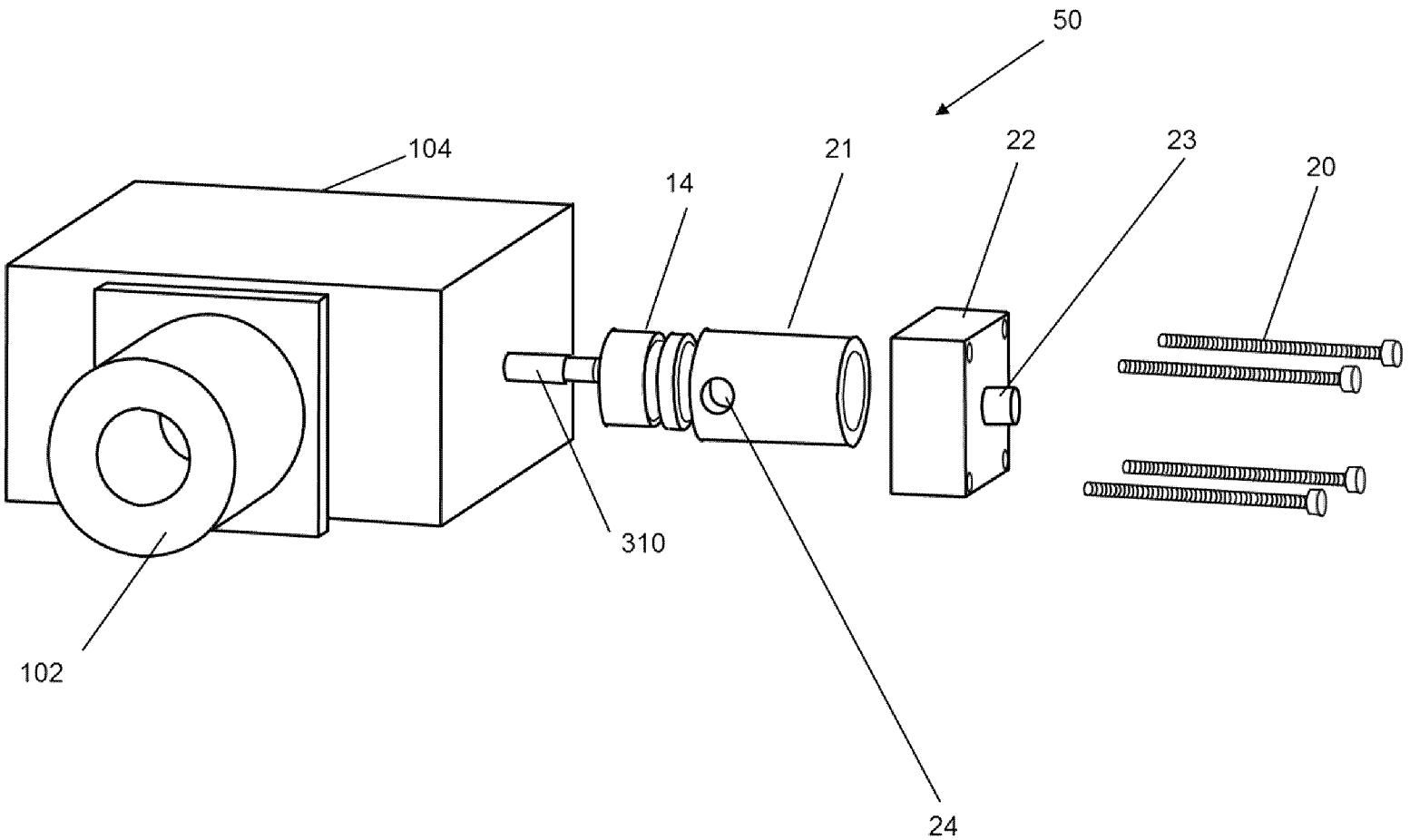
FIG. 12 is a perspective view of a compressor cylinder and single yoke of the drive system.

FIG. 12 illustrates an exploded view of a single compressor end 50. A linkage 310 extends from the drive system base 104, which is connected to a compressor piston 14 that is driven within a compressor cylinder 21. It can be appreciated that the other compressor ends 50 would be connective in a similar manner. The cylinder 21 includes an air inlet port 24 and is coupled to a compressor head 22. The compressor head 22 is secured to the cylinder 21 and drive system base 104 using a set of threaded bolts 20. The compressor head supports an outlet adapter 23.

Figure 14:
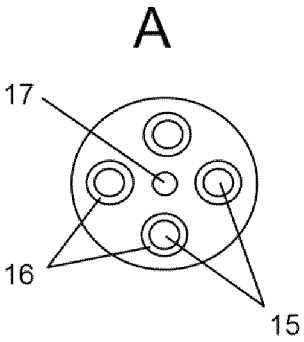
FIG. 14 illustrates end view A shown in FIG. 13.
Figure 15:
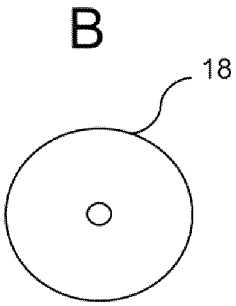
FIG. 15 illustrates end view B shown in FIG. 13.
Figure 13:
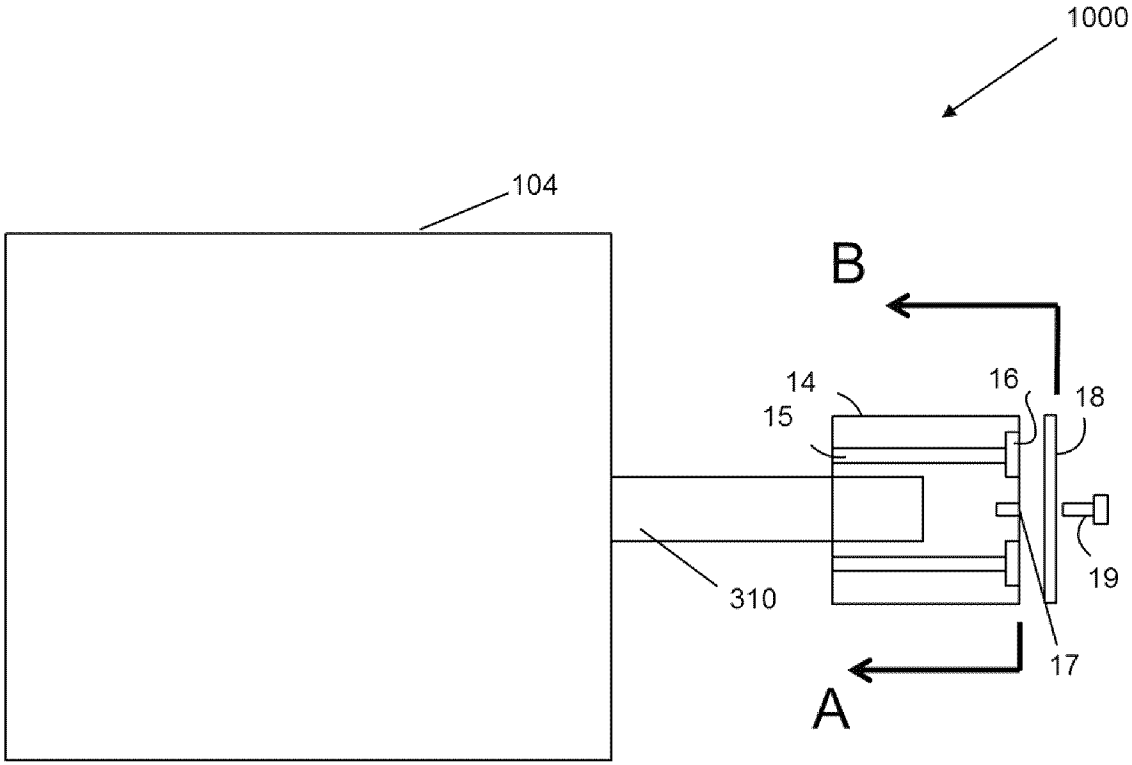
FIG. 13 is a schematic diagram of the compressor piston.

FIG. 13 provides a plan view of the base 104 and a sectional view of the compressor piston 14 that attaches to the linkage 310. The compressor piston 14 includes passages 15 that fluidly connect the base-side region of the interior cylinder 21 to respective actuation areas 16 that are wider than the passages 15 to increase the surface area of air applied to a flapper valve 18 that is actuated during a discharge stroke, as explained in greater detail below. The flapper valve 18 is attached to the outlet side of the piston 14 using a mounting screw 19 and corresponding threaded socket 17. FIG. 14 provides end view A denoted in FIG. 13, and illustrates that in this example, the piston 14 includes a series of four passages 15 and corresponding actuation areas 16. FIG. 15 illustrates end view B denoted in FIG. 13 and provides an external view of the flapper valve 18.

Figure 16:
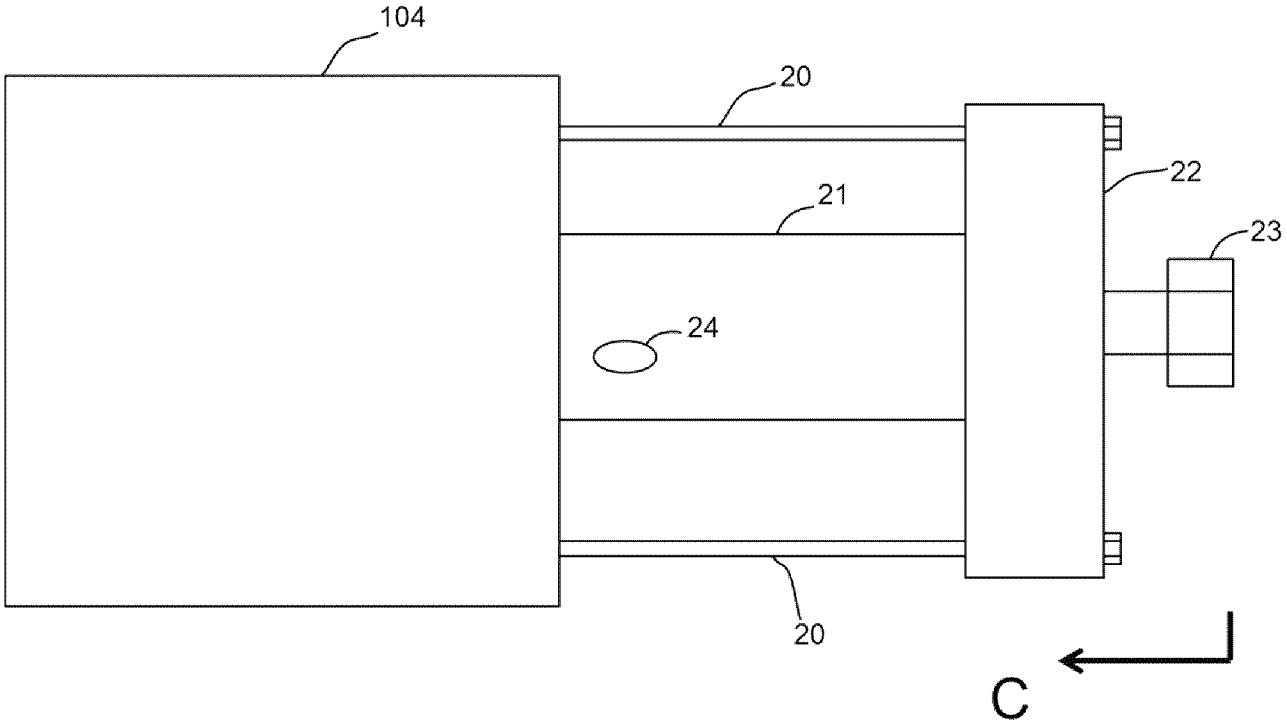
FIG. 16 is a plan view of an assembled compressor piston, cylinder, and cylinder head.
Figure 17:
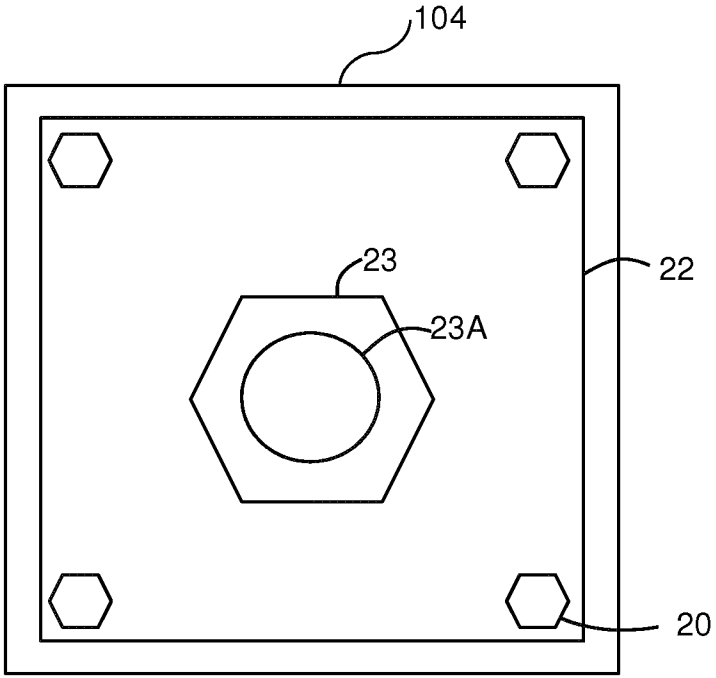
FIG. 17 illustrates end view C shown in FIG. 16.

FIG. 16 is an assembled plan view showing the cylinder 21 secured between the base 104 and the compressor head 22 using the set of bolts 20. FIG. 16 also illustrates the air intake port 24 and output adapter 23. When assembled as shown in FIG. 16, the piston 14 in FIG. 13 is driven within the cylinder 21 by the linkage 310 to compress air drawn through the intake port 24 and supply compressed air, e.g., to an instrument air line 3000 via the outlet adapter 23. FIG. 17 provides end view C denoted in FIG. 16 and shows an end view of the outlet adapter 23 secured to the compressor head 22 by securing the bolts 20 in the base 104.

Figure 18:
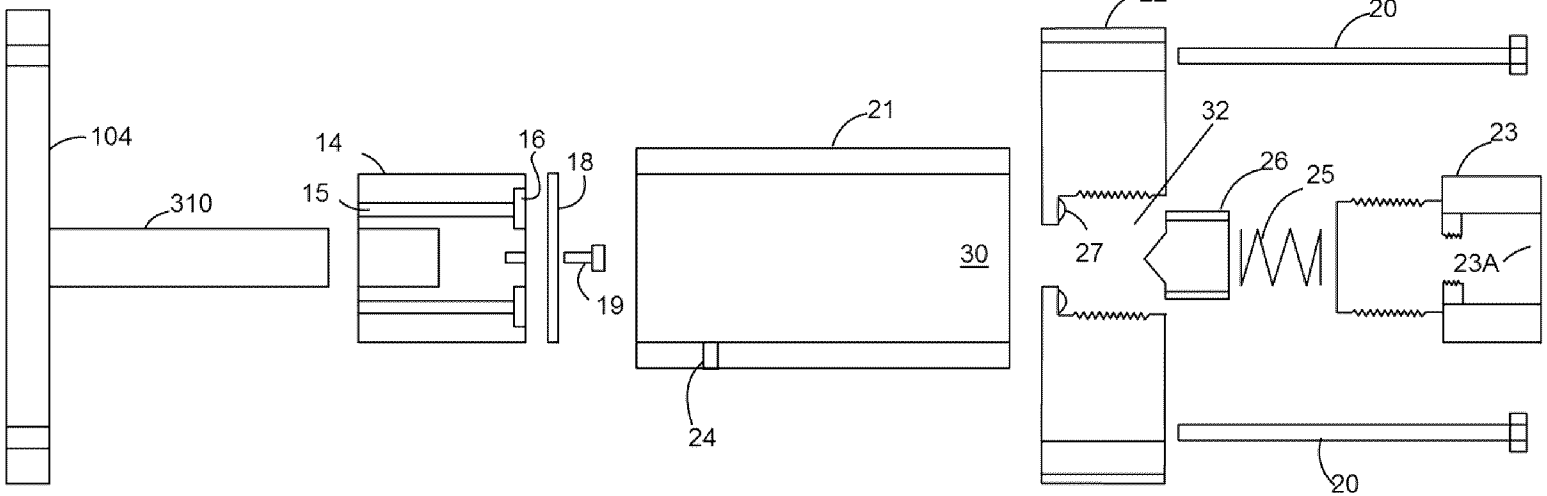
FIG. 18 is an exploded sectional view of the compressor piston, cylinder, cylinder head and internal components.

FIG. 18 is an exploded view of a compressor assembly that is coupled to a particular linkage 310 of the drive system 104. The linkage 310 connects to one end of the piston 14 and the flapper valve 18 is secured to the other end of the piston 14 using the mounting screw 19. The cylinder 21 contains the piston 14 and is secured between the drive system 104 and the compressor head 22 by feeding the threaded bolts 20 through passages in the compressor head 22 and threading the bolts 20 into threaded sockets in the drive system base. This defines an air compression chamber 30 between the flapper-end of the piston 14 and the compressor head 22. The compressor head 22 includes a threaded outlet chamber 32 that accommodates a valve shuttle 26 and spring 25 or other resilient member. The chamber 32 includes a valve seat 27 against which the valve shuttle 26 bears under the force imparted by the spring 25. Compressed air from the compression chamber 30 acts on the valve shuttle 26 to expel compressed air form the compressor head 22. The mounting screw 19 can be seated such that it also bears against the valve shuttle 26 during the compression stroke to ensure that the valve shuttle 26 is unseated to release the compressed air through the outlet adapter 23.

The outlet adapter 23 is threaded into the chamber 32 to secure the outlet adapter 23 to the compressor head 22. The outlet adapter 23 includes a threaded outlet port 23A that enables a compressor line (not shown) to be threaded to the compressor end 50 to receive the compressed air.

Figure 20:
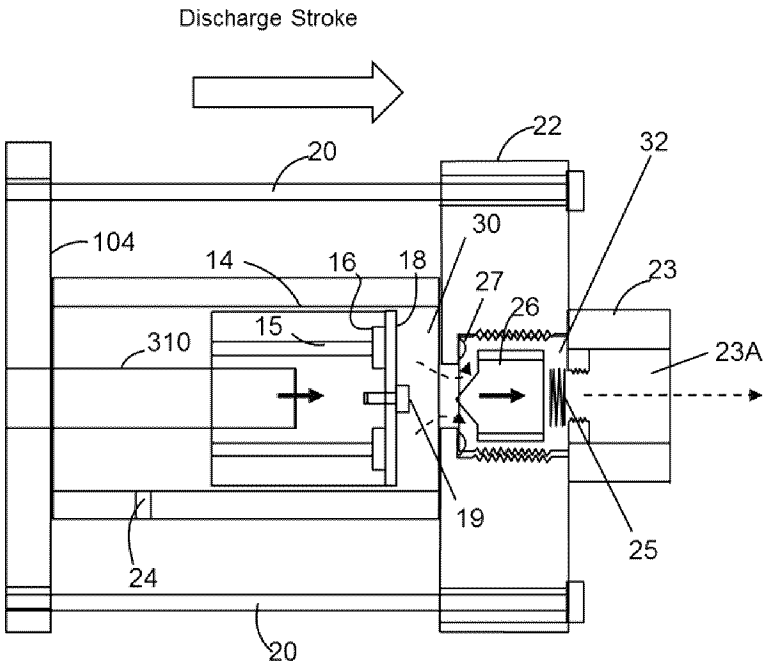
FIG. 20 is a schematic diagram of the compressor cylinder during a discharge stroke.
Figure 19:
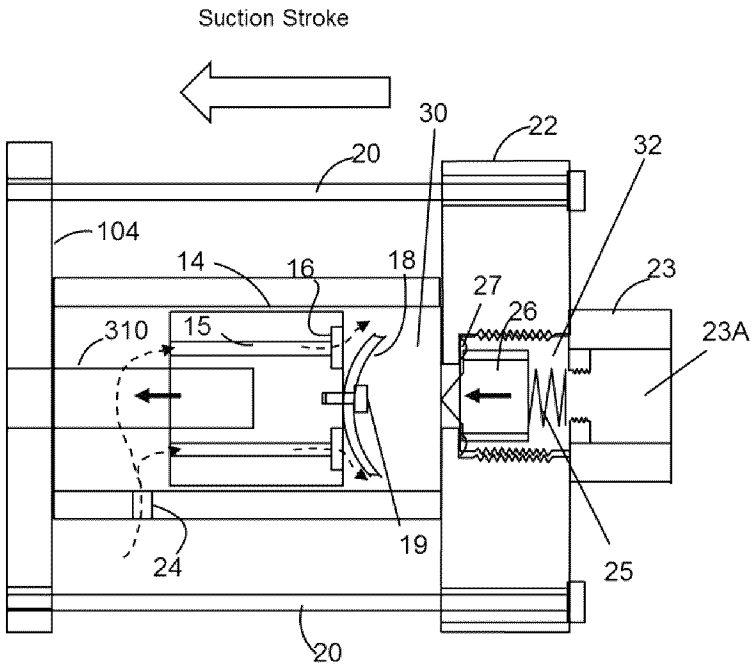
FIG. 19 is a schematic diagram of the compressor cylinder during intake suction stroke.

FIGS. 19 and 20 provide sectional views of the compressor end 50 to demonstrate the enhanced vacuum actuation. FIG. 19 illustrates a suction stroke during which the piston 14 descends away from the compressor head 22, from an extended position where the piston 14 is against the inner surface of the compressor head 22, towards the drive system 104. As seen in FIG. 19 using dashed lines, during the suction stroke a vacuum is developed to draw atmospheric pressure into the compression chamber 30. That is, air that enters the air inlet port 24 is directed into the compression chamber 30 through the passages 15 and corresponding actuation areas 16. This drawn air flexes the flapper valve 18 as the piston 14 descends from the compression head 22. The actuation areas 16 increase the surface area against the flapper valve 18 thus allowing greater lift of the flapper valve 18. In this way, atmospheric air can enter and be trapped in the compression chamber 30 during the suction stroke to provide air that is compressed during the subsequent discharge stroke, shown in FIG. 20.

The discharge stroke illustrated in FIG. 20 occurs as the piston ascends towards the compressor head 22. The flapper valve 18 closes when this stroke begins, and the piston compresses the air as the compression chamber 30 decreases in volume. The compressed air lifts the valve shuttle 26 from the valve seat 27 to enable the compressed air to pass through the outlet adapter 23 and outlet port 23A. As noted above, at the end of the discharge stroke, the mounting screw 19 will provide additional lift of the valve shuttle 26 (if necessary) to ensure that the compressed air escapes the compression chamber 30.

The compressed air that is expelled from the outlet port 23A can be used as instrument air or in a standalone compressor unit. When coupled with the motor and drive system, this enables an efficient solar powered instrument air system to be created, and even converted from the drive system used to drive a chemical injection pump, e.g., on the same site.

It can be appreciated that the drive system 104 shown herein can also be stacked for driving multiple sets of four compressor cylinders. It can also be appreciated that the relative orientations of the motor, drive system, and cylinders can be rotated or rearranged and need not be exactly as shown in the exemplary drawings.

For simplicity and clarity of illustration, where considered appropriate, reference numerals may be repeated among the figures to indicate corresponding or analogous elements. In addition, numerous specific details are set forth in order to provide a thorough understanding of the examples described herein. However, it will be understood by those of ordinary skill in the art that the examples described herein may be practiced without these specific details. In other instances, well-known methods, procedures and components have not been described in detail so as not to obscure the examples described herein. Also, the description is not to be considered as limiting the scope of the examples described herein.

It will be appreciated that the examples and corresponding diagrams used herein are for illustrative purposes only. Different configurations and terminology can be used without departing from the principles expressed herein. For instance, components and modules can be added, deleted, modified, or arranged with differing connections without departing from these principles.

Although the above principles have been described with reference to certain specific examples, various modifications thereof will be apparent to those skilled in the art as outlined in the appended claims.

The invention claimed is:

1. A transmission for use with a prime mover to simultaneously drive a plurality of potential energy storage devices each configured to convert, using reciprocal linear motion thereof, power from the prime mover to potential energy, the transmission comprising:

a housing defining an interior chamber;

a drive shaft extending from a first end configured for operative coupling to the prime mover and through the chamber, wherein the drive shaft is rotatably supported in fixed location relative to the housing so as to rotate about a fixed axis defined by the drive shaft;

a cam wheel mounted to the drive shaft so as to be disposed in the chamber for rotation with the drive shaft, wherein the cam wheel is mounted in eccentric relation to the drive shaft with a periphery of the cam wheel encompassing the axis of the drive shaft so that the cam wheel rotates in planetary motion relative to the drive shaft;

a set of reciprocating members configured to be received in the chamber and supported within the housing for respective linear reciprocal movement in respective longitudinal directions of the reciprocating members;

wherein each reciprocating member comprises a base portion spanning diametrically across the cam wheel in the respective longitudinal direction of the reciprocating member from one end thereof to an opposite end both located outwardly of the cam wheel, the base portion locating a central slot receiving the drive shaft therethrough;

wherein each reciprocating member further comprises flanges at the opposite ends thereof which project from the base portion in an axial direction of the drive shaft to define inner cam surfaces located in a rotational plane of the cam wheel in opposite relation to the cam wheel such that the planetary motion of the cam wheel acts to actuate the reciprocal linear movement of the reciprocating member;

wherein the central slot of each reciprocating member is elongated in the respective longitudinal direction of the reciprocating member; and output shafts carried on the ends of the reciprocating members so as to move therewith in the respective linear reciprocal movement;

wherein each output shaft extends outwardly from a different one of the ends of a respective one of the reciprocating members and through the chamber to an outside of the housing for operative coupling to one of the potential energy storage devices to drive said potential energy storage device.

2. The transmission of claim 1 in combination with the potential enemy storage devices including at least one fluid end respectively releasably connected to one of the output shafts and configured to pump a liquid;

at least one cylinder respectively releasably connected to another one of the output shafts and configured to compress a gas; and wherein the at least one fluid end and the at least one cylinder are fluidically communicated with a common target structure for injecting the liquid and the gas therein.

3. The transmission of claim 2 wherein the at least one fluid end comprises a plurality of fluid ends respectively releasably connected to different output shafts and arranged to receive different liquid chemicals from a chemical supply for injection into the target structure.

4. The transmission of claim 2, wherein each fluid end comprises:

a piston arranged for movement in the reciprocal linear motion of the potential enemy storage device defined by the fluid end;

an inlet for receiving a flow of the liquid to be pumped;

an outlet for discharging the liquid;

a threaded vent for receiving a cap to selectively discharge the liquid during priming; and a manual primer for priming the fluid end.

5. The transmission of claim 4 wherein each fluid end further comprises a threaded priming valve outlet including a priming valve and the threaded vent.

6. The transmission of claim 2 wherein the gas is selected from a group comprising: air, vapor.

7. The transmission of claim 1 in combination with the prime mover, wherein the prime mover is a three-phase electric motor.

8. The transmission of claim 1 in combination with the prime mover, wherein the prime mover is an electric motor powered by a photovoltaic power source.

9. The transmission of claim 1 wherein the set of reciprocating members comprises a pair thereof disposed on opposite sides of the cam wheel with respect to the axial direction of the drive shaft.

10. The transmission of claim 1 wherein the output shafts lie in a common plane as defined by the rotational plane of the cam wheel.

11. The transmission of claim 1 wherein the inner surfaces of each reciprocating member are planar and are oriented tangentially to the periphery of the cam wheel which is circular in shape.

12. The transmission of claim 1 wherein the inner surfaces of each reciprocating member are planar and are oriented orthogonally to the respective longitudinal direction of the reciprocating member.

13. The transmission of claim 1 further including a second housing receiving the drive shaft through a central portion thereof, a second eccentric cam wheel in the central portion of the second housing, a second set of reciprocating members received in plural pairs of diametrically opposite arm portions of the second housing and operatively coupled to the second eccentric cam wheel, and distinct output shafts carried by the second set of reciprocating members for driving another set of potential energy storage devices.

14. The transmission of claim 13 wherein the output shafts carried by the second set of reciprocating members are angularly offset from the output shafts carried by the first set of reciprocating members relative to the axis of the drive shaft.

* * * * *